US006140568A

United States Patent [19]

Kohler

[11] Patent Number: 6,140,568

[45] Date of Patent: Oct. 31, 2000

[54] SYSTEM AND METHOD FOR AUTOMATICALLY DETECTING A SET OF FUNDAMENTAL FREQUENCIES SIMULTANEOUSLY PRESENT IN AN AUDIO SIGNAL

[75] Inventor: Joseph Louis Kohler, Coral Springs, Fla.

[73] Assignee: Innovative Music Systems, Inc., Coral Springs, Fla.

[21] Appl. No.: 09/186,818

[22] Filed: Nov. 5, 1998

Related U.S. Application Data

[60] Provisional application No. 60/064,726, Nov. 6, 1997.

[51] Int. Cl.[7] ..... G10H 7/00

[52] U.S. Cl. ..... 84/616; 84/654

[58] Field of Search ..... 84/616, 654, 681, 84/645

[56] References Cited

U.S. PATENT DOCUMENTS

| | | | |
|---|---|---|---|
| 3,603,738 | 9/1971 | Focht . | |
| 3,662,261 | 5/1972 | Barthold | 324/78 R |
| 3,683,162 | 8/1972 | Jacob et al. | 235/156 |
| 3,704,414 | 11/1972 | Herbst | 324/79 D |
| 3,740,476 | 6/1973 | Atal . | |
| 3,766,818 | 10/1973 | Prohofsky | 84/454 |
| 3,803,390 | 4/1974 | Schaepman | 235/152 |
| 3,812,432 | 5/1974 | Hanson | 328/138 |
| 3,820,621 | 6/1974 | Clarisse | 324/78 |
| 3,852,535 | 12/1974 | Zurcher | 179/1 SA |
| 4,014,237 | 3/1977 | Milde | 84/1.12 |
| 4,021,653 | 5/1977 | Sharp et al. | 235/152 |
| 4,028,985 | 6/1977 | Merritt | 84/454 |
| 4,031,462 | 6/1977 | Bouvier et al. | 324/77 B |
| 4,041,783 | 8/1977 | Onoda | 73/552 |
| 4,068,609 | 1/1978 | Drukarch | 364/484 |
| 4,070,618 | 1/1978 | Thomas | 324/78 D |
| 4,151,775 | 5/1979 | Merriman . | |
| 4,164,626 | 8/1979 | Fette | 179/1 SC |
| 4,217,808 | 8/1980 | Slepian et al. | 84/454 |
| 4,245,325 | 1/1981 | Imagawa et al. | 364/724 |
| 4,273,023 | 6/1981 | Mercer | 84/454 |
| 4,280,387 | 7/1981 | Moog . | |
| 4,300,431 | 11/1981 | DeRocco . | |
| 4,313,361 | 2/1982 | Deutsch . | |
| 4,354,418 | 10/1982 | Moravec et al. | 84/454 |
| 4,377,961 | 3/1983 | Bode . | |
| 4,399,732 | 8/1983 | Rothschild et al. | 84/454 |
| 4,429,609 | 2/1984 | Warrender | 84/454 |
| 4,457,203 | 7/1984 | Schoenberg et al. | 84/454 |
| 4,627,323 | 12/1986 | Gold . | |
| 4,665,790 | 5/1987 | Rothschild | 84/454 |
| 4,688,464 | 8/1987 | Gibson et al. | 84/454 |
| 5,018,428 | 5/1991 | Uchiyama et al. | 84/616 |
| 5,202,528 | 4/1993 | Iwaooji | 84/616 |
| 5,210,366 | 5/1993 | Sykes, Jr. | 84/616 |
| 5,349,130 | 9/1994 | Iwaooji | 84/616 |
| 5,400,261 | 3/1995 | Reynolds . | |
| 5,447,438 | 9/1995 | Muraki | 434/307 |
| 5,504,270 | 4/1996 | Sethares | 84/645 |
| 5,973,252 | 10/1999 | Hildebrand | 84/645 X |

*Primary Examiner*—Jeffrey Donels
*Attorney, Agent, or Firm*—David P. Lhota, Esc.; Bowen & Lhota, P.A.

[57] ABSTRACT

A system and method for automatically detecting and identifying a plurality of frequencies simultaneously present in an audio signal, as well as the duration, amplitude, and phase of those frequencies, then filtering out harmonic components to determine which frequencies are fundamentals. The system includes a computer readable medium of instruction code that decomposes the signal into its component sine waves by computing and comparing correlations between the input signal and sine waves at various phase and amplitude combinations. The system also employs several optimization and error correction routines.

58 Claims, 26 Drawing Sheets

Notes:
1. Sample windows are a constant size.
2. The beginning points of sample windows are not equally spaced, but begin at fractions of the beat as recorded by the user.
3. Some samples are included in more than one sample window, as in the overlap of #1 and #2.
4. Some samples are not included in any sample window, as in the gap between #5 and #6.

Finding Amplitude and Phase Resulting in Best Score for a Single Frequency

| | - Qtr Wave | | | | | 0 | | | | | + Qtr Wave |
|---|---|---|---|---|---|---|---|---|---|---|---|
| + Midi Max | | | | | | | | | | | |
| 3 | | | | | | | | | #14 **81934** | #13 **81702** | #15 **81840** |
| 2 | | | | | | | | | #12 **80247** | #11 **79218** | #10 **80262** |
| 1 | | | | | | | | | | | |
| 0 | 82347 | 82347 | 82347 | 82347 | 82347 | #1 **82347** | 82347 | 82347 | 82347 | 82347 | 82347 |
| -1 | | | #6 **82189** | #5 **82068** | #4 **82710** | #2 **83021** | #3 **83898** | | | | |
| -2 | #10 **80262** | #9 **81770** | #7 **82049** | #8 **82404** | | | | | | | |
| -3 | #15 **81840** | | | | | | | | | | |
| - Midi Max | | | | | | | | | | | |

Phase

#number sequence of evaluating amplitude/phase combinations bold calculated score

<u>underline</u> best score at each amplitude, showing best phase

Notes:
1. Line shows how best scores are tracked to the only minima and best score for the frequency, at #11.
2. Scores at amplitude zero, regardless of phase, are the baseline scores.
3. Parameter reversal occurs at #10.

Fig. 20

Effect of the Stabilization Filter Upon a Single Note Through Time
Using Various "Minimum Length" Values

| Minimum Length | | | | | | | | | | | | | | | | | | |
|---|---|---|---|---|---|---|---|---|---|---|---|---|---|---|---|---|---|---|
| Orig | 0 | 0 | 45 | 0 | 34 | 0 | 0 | 24 | 35 | 0 | 67 | 55 | 12 | 0 | 0 | 88 | 47 | 23 |
| 1 | 0 | 0 | 45 | 0 | 34 | 0 | 0 | 24 | 35 | 0 | 67 | X | 12 | 0 | 0 | 88 | X | 23 |
| 2 | 0 | 0 | 0 | 0 | 0 | 0 | 0 | 24 | X | X | X | X | 12 | 0 | 0 | 88 | X | 23 |
| 3 | 0 | 0 | 0 | 0 | 0 | 0 | 0 | 0 | 0 | 0 | 67 | X | X | X | X | X | X | 23 |

Sample Windows Through Time →

Notes:
1. The first row shows the amplitudes prior to filtering.
2. Lines show when the note starts and stops sounding.
3. The number at the beginning of the line is the "key on" velocity.
4. The number at the end of the line is the "key off" velocity.
5. Amplitude of zero indicates note is off.

Fig. 21

Frequency response of filter applied when examining Frequency = 8.

Filter A: $Y_n = (2X_n + X_{n-2L} + X_{n+2L}) / 4$, where X is the wave sample, and L = Sample Rate / Frequency / 2.

Filter B: $Z_n = (2X_n - Y_{n-L} - Y_{n+L}) / 4$, where Y is the output of Filter A.

The combined filter is expressed as: $Z_n = (-X_{n-3L} + 2X_{n-2L} - 3X_{n-L} + 4X_n - 3X_{n+L} + 2X_{n+2L} - X_{n+3L}) / 16$.

SYSTEM AND METHOD FOR AUTOMATICALLY DETECTING A SET OF FUNDAMENTAL FREQUENCIES SIMULTANEOUSLY PRESENT IN AN AUDIO SIGNAL

CROSS-REFERENCE TO RELATED APPLICATIONS

This application claims the benefit of provisional application Ser. No. 60/064,726 filed Nov. 6, 1997.

STATEMENT REGARDING FEDERALLY SPONSORED RESEARCH OR DEVELOPMENT

Not applicable.

BACKGROUND OF THE INVENTION

1. Field of the Invention

The instant invention generally relates to a system and method for detecting frequency in an audio signal, and, more particularly, to a system and method for identifying a plurality of frequencies simultaneously present in an audio signal, as well as the period, amplitude, and phase of those frequencies, then filtering out the harmonic components so as to automatically detect the notes played in a polyphonic musical recording.

2. Description of Related Art

It is well known that no system or method exists for conveniently and reliably identifying a plurality of frequencies and corresponding phases, amplitudes and duration simultaneously present in a wave form, such as a musical recording. A musical recording usually comprises a plurality of notes, and each note comprises a frequency, phase, amplitude and duration. People have been desirous of discovering such a system for recording and reproducing music as it is created, drafting a practice sequence of music, or creating sheet music from a prerecorded song. Electronic equipment and software are available for transcribing a monophonic waveform, that is, music that is played one note at a time, in a musical information data interface ("MIDI") file. A wave file stores an audio signal in its recorded form. A MIDI file contains music information that conforms to the musical instrument digital interface specification. MIDI files specify frequency, period and amplitude of musical notes and consume less space than wave files. MIDI files enable music to be automatically transcribed into notation, played on a MIDI-enabled musical instrument, or fed into a sequencer. However, to create the MIDI file the music must be played on a MIDI-enabled instrument, which requires the user to know how to play the music. Some systems have recently been developed which convert monophonically played music into a MIDI file. These types of systems have been referred to as automatic transcription devices. As noted, existing transcription technology can only detect one note at a time. Consequently, there exists a need for a system and method that converts wave files containing polyphonic music to MIDI files.

Attempts have been made to create transcription systems which recognize polyphonic music, i.e., music containing multiple notes such as chords. These attempts, however, have been unsuccessful. The prior systems simply cannot recognize several notes played at the same time. Accordingly, they cannot take a polyphonic wave form recording of a song and convert it to a MIDI file. Current software and related systems can only detect monophonic wave forms or music. A wave form to MIDI file converter has not been previously developed because of the difficulty in detecting frequencies/notes present in a signal having simultaneously presented multiple notes. Polyphonic music produces an aggregate wave form that is extremely difficult to analyze because of the inherent problem associated with measuring the period. The period is a measure of the combination of notes, rather than a single note. The more notes that are played, the longer the period of the wave form. Even if the aggregate wavelength could be determined, phase and amplitude must still be ascertained. In addition, sets of notes present at any single time are likely to change within the period of the aggregate wave form.

Some systems have been found that purport to detect multiple simultaneous pitches, but they are not suitable for musical applications or for recognizing the notes played in polyphonic music or sound. Pitch detection has been used for studying speech, stress in human speech and the fundamental frequency of the voice chord, for ear training, and for transcribing music played monophonically. AFI provides a pitch reader that claims to transcribe music if played monophonically. Cakewalk Pro Audio 6.0 includes a pitch detection feature that accomplishes the same thing. Sound2 MIDI from Audio Works, AutoScore 1.0 from Wildcat Canyon Software and music@Passport from Passport Designs also claim to have audio to MIDI conversion software that can detect notes played monophonically. They are designed to recognize pitches sung or played into a sound card while a sequencer program records the MIDI sequence. While the foregoing may disclose software for monophonic sound to MIDI conversion, each recognizes their inability to convert polyphonic music or sounds into a MIDI format.

There are a few systems known which try to detect the frequencies present in an input signal, but they fail to address and solve the above-noted problems. For instance, U.S. Pat. Nos. 4,245,325, 4,068,309, 4,031,462, and 3,803,390 employ Fourier analysis, FFT, or Fast Hartley transforms for detecting multiple frequencies in an input signal. These solutions are not accurate enough to detect small changes in frequency. To use FFT without error requires a window size that is a multiple of the aggregate wavelength. Large windows such as these create unrealistic all massive demands on system resources. Simply stated, FFT solutions are not practical for personal computers. U.S. Pat. Nos. 4,014,237 and 3,683,162 try to detect multiple frequencies using a series of hardware-based, narrow frequency band-pass filters with rapid cutoffs, each tuned to a different musical note. By contrast, the instant invention determines musical pitch. Moreover, hardware-based systems in the prior art are difficult to implement and do not have narrow enough bands to prevent leakage or overlapping to adjacent notes.

The other systems known in the art which fail to teach a system capable of polyphonic audio to MIDI conversion include the following: U.S. Pat. Nos. 5,447,438; 5,349,130; 5,018,428; 4,688,464; 4,665,790; 4,627,323; 4,457,203; 4,429,609; 4,399,732; 4,377,961; 4,354,418; 4,313,361; 4,300,431; 4,280,387; 4,273,023; 4,217,808; 4,164,626; 4,151,775; 4,070,618; 4,041,783; 4,028,985; 4,021,653; 3,852,535; 3,820,021; 3,812,432; 3,766,818; 3,740,476; 3,704,414; 3,662,261; and 3,603,737. These recognize monophonic music only, like the specific products listed above.

BRIEF SUMMARY OF THE INVENTION

In accordance with the foregoing, it is a primary object of the instant invention to provide a system and method that automatically identifies an unlimited plurality of frequencies simultaneously present in an audio signal.

Another object of the instant invention is to provide a wave file to MIDI converter that detects and removes harmonics.

An additional object of the instant invention is to provide a wave file to MIDI converter that detects frequency, phase, amplitude and note duration.

It is another object of the instant invention to provide a system and method that takes an input audio signal, for example a polyphonic signal, creates a wave file, and converts the wave file into a MIDI file.

It is an additional object of the instant invention to provide a system and method for converting wave form files into MIDI files without requiring specialized hardware, such as narrow band-pass filters, although the invention can take the form of an embedded program in read-only memory (ROM).

It is a further object of the instant invention to provide a wave file to MIDI converter that converts an audio signal into a MIDI file without requiring a MIDI instrument, live performance, or the manual input of notes into a computer.

It is also an object of the instant invention to provide a wave file to MIDI converter that is readable by a microprocessor-based system and adaptable to existing personal computer systems.

It is still another object of the instant invention to provide a wave file to MIDI converter that can create a wave file that has been recorded from an audio CD, tape recording, record, or microphone.

It is still an additional object of the instant invention to provide a wave form to MIDI converter that can determine the frequencies present in a complex wave form, i.e., aggregate wave form, without requiring the sample window to be a multiple of the aggregate wavelength as with Fourier transform.

It is still a further object of the instant invention to provide a wave form to MIDI converter that decomposes or reverse-engineers a wave form sample to determine its frequency content, phase and amplitude.

It is yet another object of the instant invention to detect frequencies present in aggregate wave forms without using Fourier transform, FFT, or Fast-Hartley transform analysis.

It is yet an additional object of the instant invention to provide a wave file to MIDI converter that accepts wave files up to 2,000,000,000 bytes in size.

It is yet a further object of the instant invention to provide a wave file to MIDI converter that creates a MIDI file that can be edited in a sequencer, played back on a synthesizer, and/or transcribed into sheet music or included on Web pages.

It is again another object of the instant invention to provide a wave file to MIDI converter that filters out non-pitched content from the wave file so that it is not represented in the resulting MIDI file.

It is again an additional object of the instant invention to provide a wave file to MIDI converter that makes no presumptions about musical content based on music theory.

It is again a further object of the instant invention to provide a wave file to MIDI converter that captures pitch, attack and release volume, and duration of each note recognized.

Another object of the instant invention is to provide a wave file to MIDI converter that allows the user to hear sample tones using the same patch, MIDI channel, and note range or key selected for the profile.

An additional object of the instant invention is to provide a wave form to MIDI converter that is designed for 32-bit Windows® operating systems running on Pentium® processor.

Another object of the instant invention is to provide a wave file to MIDI converter that can filter harmonics without knowing the musical instrument or instruments responsible for the music in the wave file.

Still another object of the instant invention is to provide a wave file to MIDI converter that can track tempo.

An additional object of the instant invention is to provide a wave file to MIDI converter that has an automatic note range feature.

It is yet another object of the instant invention to provide a wave file to MIDI converter that supports active files not having header information.

A further object of the instant invention is to provide a wave file to MIDI converter that allows recognition to occur as a batch process.

Another object of the instant invention is to provide a wave file to MIDI converter that requires little system memory and storage space, recognizes the entire 128 note range defined in the MIDI specification, and contains dozens of optimizations to improve recognition speed.

An additional object of the instant invention is to provide a wave form to MIDI converter that conforms to ANSI C so that it is portable between compilers.

A further object of the instant invention is to provide a wave form to MIDI converter that allows the user interface to be configured to match different user levels (novice or expert) as well as to match how the user intends to use the generated MIDI files, i.e. transcribe them or play them back.

In light of these and other objects, the instant invention comprises a wave form to MIDI converter that receives a complex or aggregate wave form, such as an audio file containing a recording of musical information, decomposes it into its sine wave components to determine the frequencies present in the file, filters out the harmonics to determine the Fundamental Frequencies and writes the information or MIDI events to the MIDI file. Generally, the program first divides the wave form into segments called sample windows, looks for wave thresholds, compares known frequency samples to frequencies present in each sample window to derive correlation scores which are used to ascertain the frequencies present, removes harmonics and noise, and determines what fundamental notes or frequencies are present. The basic theory of the instant invention assumes that every aggregate wave form is formed as a result of a combination of sine waves, each having the properties of frequency, amplitude and phase. Each sine wave represents a fundamental note or a harmonic thereof produced by, for example, a musical instrument or a voice. If each sine wave and its properties can be identified, they may be subtracted from the aggregate wave form until the difference is zero (flat line). After identifying the frequency or frequencies present, the harmonics are filtered out. For each sample window and each potential note being examined, a sine wave is shifted in amplitude and phase until the best correlation for the sine wave is found. I have determined that it is not necessary to look at every amplitude and every phase. Rather, the instant invention follows a trend. If the score starts getting higher (worse) in one direction for either phase or amplitude, the polarity of the shift is reversed.

The instant invention also performs other tasks to save processing time. For instance, the invention does not have to look at every frequency sample in its test domain set because the correlation scores help determine whether the program is moving in the right direction. The invention also has an averager which compares adjacent windows to determine whether the same notes are present in successive windows. As each window is analyzed, the wave to MIDI converter counts or increments to maintain synchronization between the MIDI file and the wave form file. The output of the averager is fed through a harmonic filter which discerns the fundamentals from their harmonics. The fundamentals are then compared to a MIDI threshold to see if the fundamental meets a minimum threshold level. This helps to weed out harmonics which are mistaken for fundamentals. A stabilizer takes the fundamentals and detects and removes transients that could be mistaken for fundamentals. Transients are isolated by requiring the detected fundamentals to be present in a certain number of consecutive windows. If it passes this test, the fundamental or note is written to the MIDI file along with its velocity and delta time. Once the note is no longer present it is written to the MIDI file as a note off event.

The instant invention can listen to a user's music and determine its frequency content for reproducing the wave form into a MIDI file that can then be converted to sheet music, synthesized, or manipulated in other desired from. The music or wave form is simply copied into the computer from an audio CD, a tape recording, a record, an existing wave file, an ephemeral performance, or other form, and converted to a MIDI file, suitable for editing in a sequencer, playing back on a MIDI-enabled musical instrument, or transcribing into sheet music. Although the instant invention is discussed with respect to converting music into workable MIDI files, the instant invention can be used for ascertaining the frequencies present in any aggregate or simple wave form.

The wave form to MIDI conversion of the instant invention comprises computer readable medium of instructions, such as software, which is generally referenced as a recognizer. The recognizer converts a previously created wave file into a MIDI file. Once the music has been converted into the MIDI file, it may be transcribed into sheet music or fed into a sequencer, MIDI interface, and synthesizer for producing an audio output. The recognizer comprises a number of sub-routines, as discussed above, which process the sample windows and information contained in the header of the wave file input, performs system initialization, sets parameters based on user input, and, where missing, default values, determines wave format, calculates known sine wave frequency samples for the domain set, initializes comparison between current and previous sample windows, filters out harmonics, optimizes the processing of the wave file, and performs the other operations as discussed in more detail in the description of the preferred embodiment. The program or software comprises an article of manufacture for use in computer systems and similar systems employing microprocessors capable of reading the medium of instructions as defined by the wave form file to MIDI file converter program of the instant invention. The recognizer breaks down the wave file, or input wave form, referred to herein as an aggregate/complex wave form, into digitized segments based on time called sample windows, and analyzes the complex wave form sample one window at a time. The invention can be set up to process the entire 128 note range defined in the MIDI specification, or more, or less. Each sample window is analyzed by first running the waveform through a digital filter to alternate lower frequencies, then subtracting preselected sine waves at known frequencies from the wave form sample and squaring the difference to derive a correlation score. The frequencies are taken from a table of sine waves corresponding to musical notes. Ideally, the correlation score would result in a summation of zero once all frequencies are subtracted. However, in reality, the program looks for those frequencies which result in a summation that is closest to zero. Since a note comprises frequency, amplitude, and phase, the sine waves are compared to the aggregate wave form at different phases and amplitudes in a predetermined order. Accordingly, the amplitude and phase are adjusted to determine the parameters of the sine wave which yield the best or lowest correlation score. This process may be repeated for each frequency in the frequency domain set which is being analyzed, but not necessarily. The sine waves which yield the highest amplitudes constitute maximas. That is, if the entire set of amplitudes at the best correlation scores for each frequency in the domain set were graphed, the frequencies present in the aggregate wave form can be identified by maximas or peaks in the graph, indicating that those frequencies are present in the aggregate wave form.

The instant invention may also determine whether clusters are present in the aggregate wave form. A cluster comprises two notes which simultaneously exist in time, that is, right next to each other. The cluster sub-routine cancels out the frequencies found in the aggregate wave form by subtracting them and then recalculating the best correlation score for the detected frequency. The resulting amplitude for the best correlation found when recalculating is then compared with the amplitude for the best correlation found for the next frequency. If the amplitude for the correlation score for the second frequency ends up being a maxima, then it is known that the second frequency is present along with the first frequency. Therefore, a cluster has been detected.

The correlation routine of the instant invention also comprises an optimization routine. The optimization routine looks for trends in the resultant scores. For instance, every frequency in the possible frequency domain set is not always examined. A frequency domain set may be limited to the 88 keys of a piano. If it is known that all frequencies conform to a specific musical key, then only the frequencies in the known key are examined. With respect to amplitude and phase, the recognizer program reverses polarity of the amplitude and/or phase when the scores start yielding higher or worse correlations. By reversing polarity, the program changes the direction of the amplitude and phases which are examined to approach the frequencies present in the aggregate wave form more quickly. That is, if the amplitude and/or phases keep yielding higher results in one direction, then it is known that the score will only get worse as the amplitude and/or phase are changed in that direction. This is known because there is only one minima for the phase-amplitude combination. Thus, the program reverses the polarity to change the direction of inquiry. Consequently, the instant invention can determine the best score without looking at each frequency, phase, and amplitude combination. This saves time.

The instant invention also includes averaging filters that help determine when combinations of notes change in the music. The averaging routine looks at two adjacent sample windows and compares the notes (frequency) and volume (amplitude) contained therein and picks out the greater amplitude of each frequency pair therein and adds them together to get a denominator. The lesser amplitude of each pair are summed together to find a numerator. The numerator is divided by the denominator to find a ratio representing the similarity of the two sample windows. Then what? The instant invention also includes harmonic filters which filter out the harmonics contained in the sine wave samples, so that only fundamentals are considered as musical notes. The harmonic filter works on the assumption that the fundamental has the greatest amplitude and that the harmonics produce decreasing amplitudes. Since fundamentals and harmonics are linear, the program is able to filter out the harmonics by again looking at trends. The recognizer of the instant invention also uses linear regression to forecast amplitudes of the harmonics to identify and ignore glitches to reduce error.

In accordance with these and other objects which will become apparent hereinafter, the instant invention will now be described with particular reference to the accompanying drawings.

BRIEF DESCRIPTION OF THE SEVERAL VIEWS OF THE DRAWINGS

FIG. 20 is a graphical representation of how various best correlation scores are located for a single frequency by testing various amplitude/phase combinations.

FIG. 21 is an illustration of the effect of the stabilization filter upon a single note through time using various "minimum length" values.

DETAILED DESCRIPTION OF THE INVENTION

Figure 1:
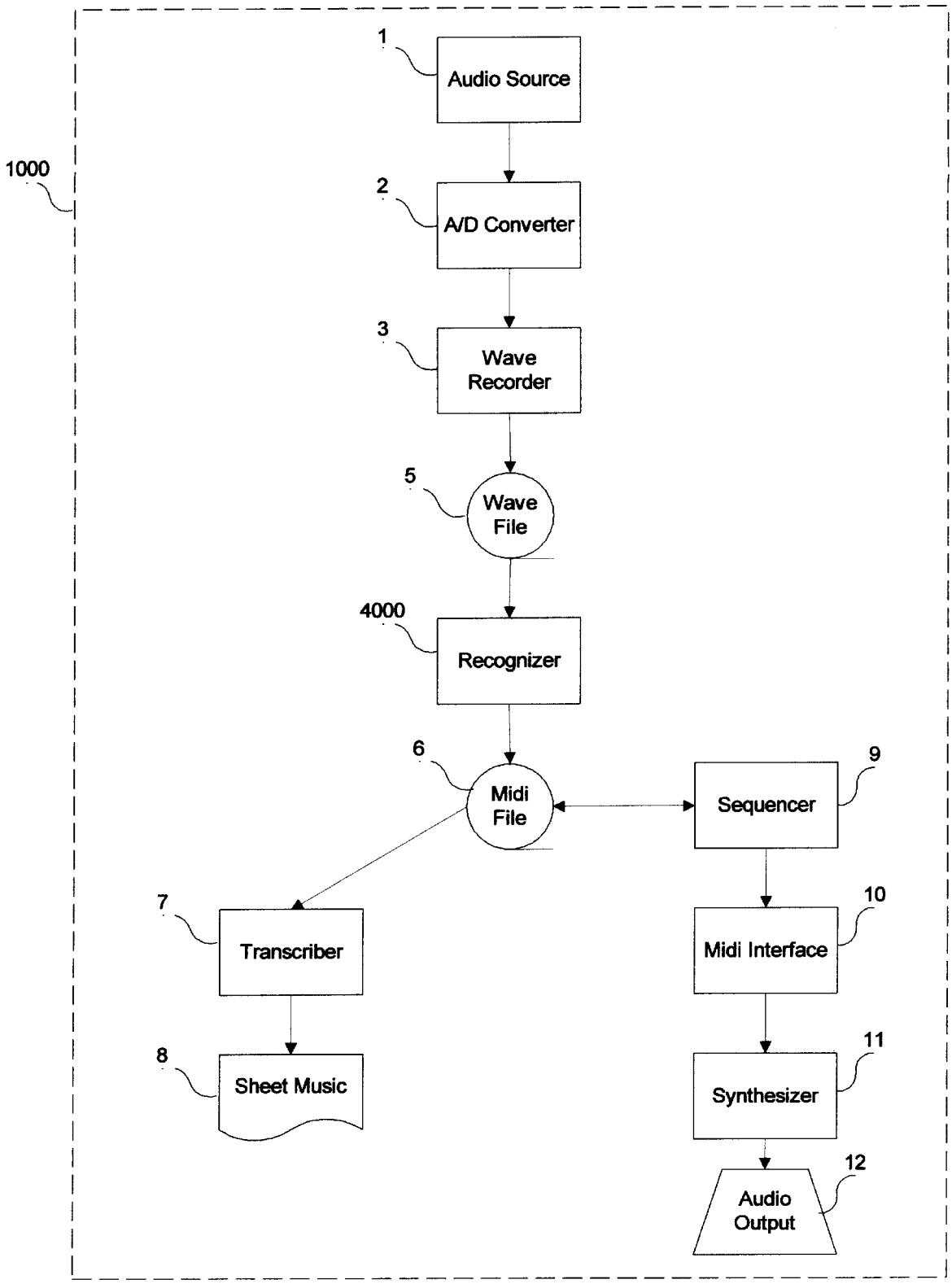
FIG. 1 is a block diagram of the instant invention as it is implemented in the context of an existing system with external elements.

With reference to the drawings, FIGS. 1–22 depict the preferred embodiment of the wave file to MIDI file converter of the instant invention, which is generally referenced by numeric character 1000. The instant invention comprises a recognizer program 4000 which recognizes which notes make up the audio signal received from audio source 1 and may also include or interface with an analog-to-digital ("A/D") converter 2, a wave file recorder 3, a wave file 5, a MIDI file 6, a transcriber 7, sheet music 8, a sequencer 9, a MIDI interface 10, a synthesizer 11, and/or an audio output 12. The invention is to the recognizer 4000 alone, but may also comprise an entire system such as 1000.

Figure 19:
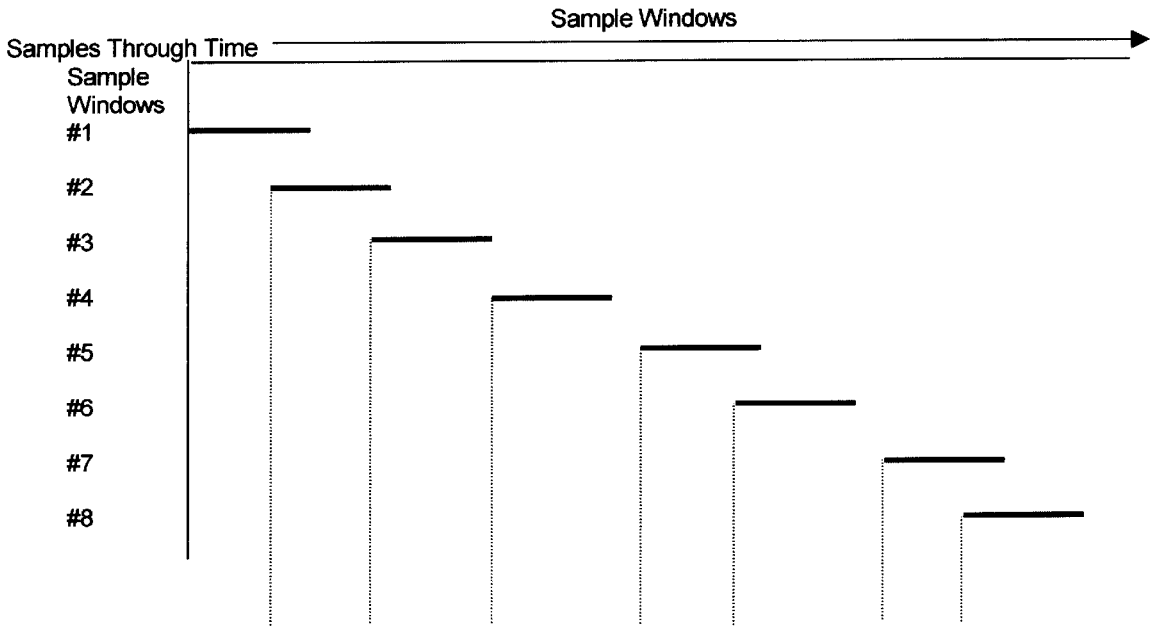
FIG. 19 is a chart illustrating the sample windows as processed through time from the waveform.

The recognizer 4000 determines the notes from an analog input signal, having a plurality of frequencies simultaneously present, by reverse engineering or decomposing the wave form. As music comprises a combination of sound or sine waves added together, the input signal comprises an aggregate or complex wave form. Consequently, the period of the aggregate wave form is always changing which makes it impossible to find the frequency. Additionally, the period is the combination of wavelengths of the component frequencies. The period itself does not indicate the frequencies present. With reference to FIG. 19, the instant invention 4000 solves this problem by breaking up the aggregate wave form into segments based on time or any other suitable basis which are referenced as sample windows. In each sample window, a plurality of sine waves in digital form are each individually subtracted from the corresponding portion of the aggregate/complex wave form to arrive at a correlation score. The lower the score, the better, whereby zero represents an ideal score. By subtracting out individual notes or frequencies from the aggregate wave form in the window, the invention 4000 is able to determine which notes or frequencies comprise the wave file, i.e., the aggregate wave form. As these notes or frequencies comprise sine waves, the instant invention includes a sine wave table from which notes are selected for subtracting from the wave file to arrive at a correlation score. The correlation score is determined as follows:

$$\Sigma(CWFS_1-A\times SWS_{1+p})^2+(CWFS_2-A\times 0SWS_{2+p})^2+\ldots(CWFS_n-A\times 0SWS_{n+p})^2=\text{SCORE}$$

Figure 11:
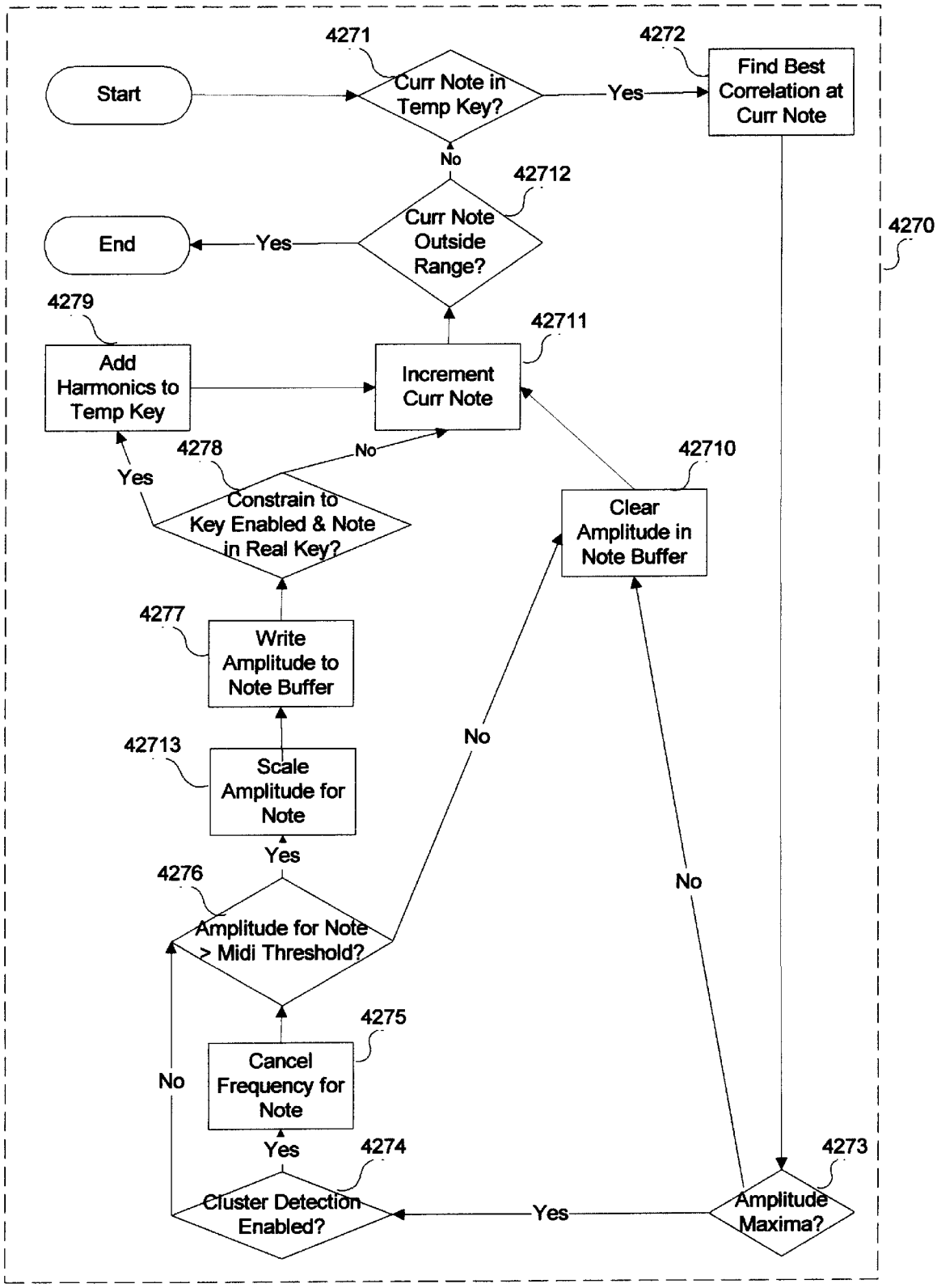
FIG. 11 is a flow diagram of the frequency spectrum sub-routine used for finding the set of frequencies present in the wave file based on the best correlation scores in accordance with the wave file to MIDI file converter of the instant invention.

$SWS_n$ represents the sine wave sample and CWFS represents the aggregate/complex wave form sample. The numeric subscripts represent the sample within the window or sine wave being examined. The process of deriving correlation scores is shown in FIG. 11 and discussed in more detail herein.

Figure 2:
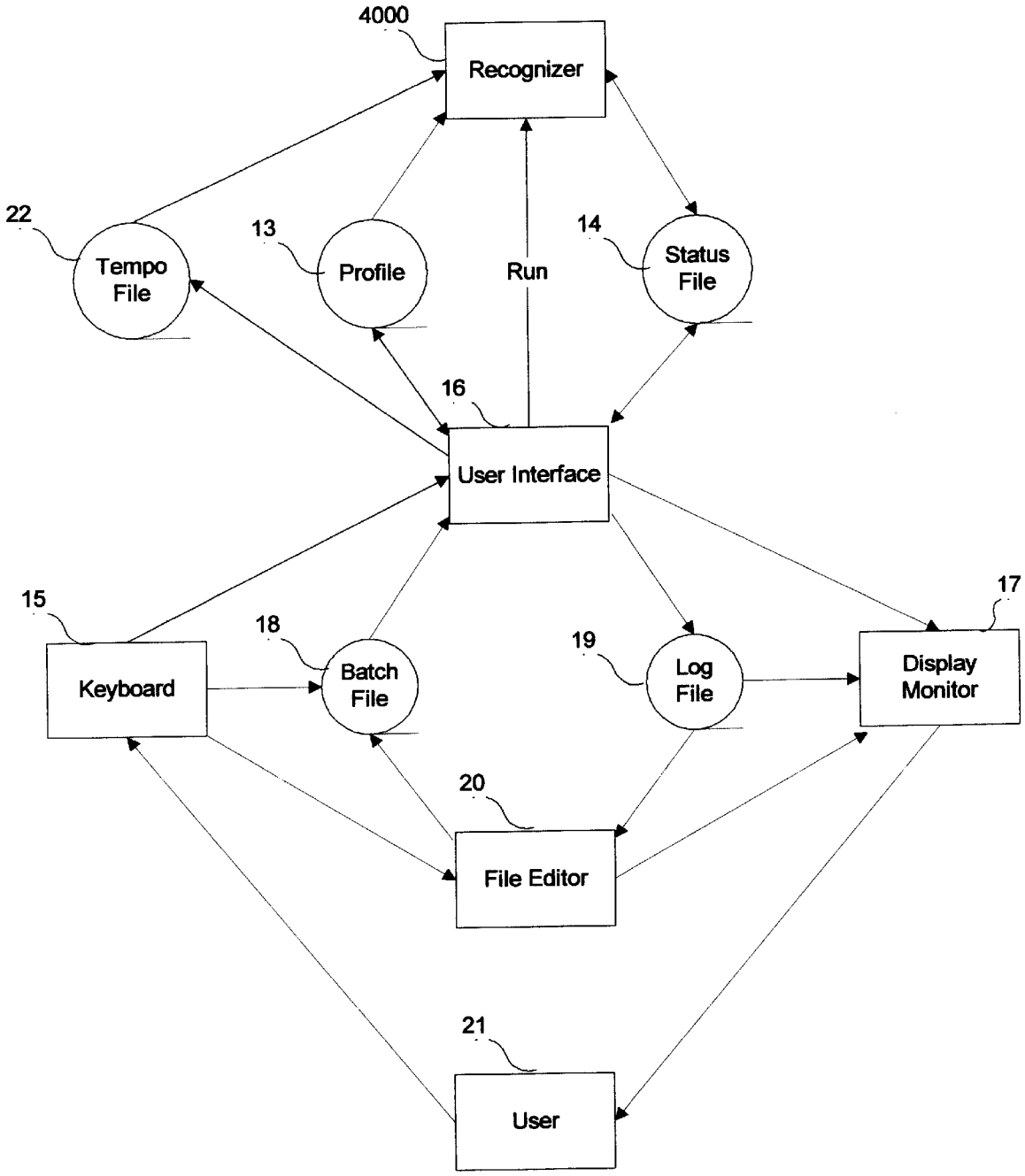
FIG. 2 is a continuation of the block diagram of FIG. 1.

The wave form to MIDI converter 1000 comprises a computer readable medium of instructions, such as software, which is generally referenced as recognizer 4000. The recognizer 4000 is employable in a computer or similar system 1000 as shown in FIGS. 1 and 2. The recognizer 4000 of the instant invention processes a wave file 5 which starts as an audio source 1, is digitized by an A/D converter 2, recorded in wave recorder 3, and then stored as a wave file 5, as shown in FIG. 1. The digitized wave file is converted into a MIDI file 6 and stored in a predetermined location by the recognizer 4000. Once the wave file 5 has been converted into the MIDI file 6, it may be transcribed by a transcriber 7 into sheet music 8, or it may be fed to a sequencer 9, MIDI interface 10, and/or synthesizer 11, to produce an audio output 12, as shown in FIG. 1. The audio source 1 comprises an electrical signal corresponding to an analog wave form from an audio source, such as a tape player, CD player, or microphone picking up a live performance. The A/D converter 2 converts the oscillating voltage levels in the electrical signal to a series of quantized values representing these voltage levels measured at regular intervals. The wave recorder 3 comprises software that controls the A/D converter 2 and stores the quantized values in a wave file 5 on the computer. The recognizer 4000, following initialization with information from the profile 13, processes sample windows of the wave file 5, detects musical information therein, and writes it to a MIDI file 6. The wave file 5 contains the digitized wave form measurements, currently using a standard Windows® wave file format, but it may also use MacIntosh®, or any other system and hardware systems. The created MIDI file 6 comprises a computer file in the standard MIDI file format, having a series of notes, information on when to strike and release each note, and the amplitude of each note when they are struck and released. The transcriber 7 comprises software that reads the MIDI files and converts them to musical notation, such as sheet music 8. The sequencer 9 comprises software which can read, edit, and play MIDI files. The MIDI interface 10 comprises a device allowing MIDI information played from a MIDI sequencer to be communicated between a computer and a synthesizer. The synthesizer 11 is a device that creates analog electrical signals that sound like musical instruments corresponding to MIDI commands. The audio output 12 converts analog electrical signals into audio wave forms, i.e., a speaker.

With reference to FIG. 2, the recognizer 4000 communicates with a profile 13, status file 14, a user interface 16 and a tempo file 22. The profile 13 may comprise a file in Windows INI format containing parameters affecting the operation of the recognizer 4000, but may be adapted for other formats as well. The profile 13 also includes the names of the wave and MIDI files created and maintained by the user interface 16. The status file 14 is used for communication between the user interface 16 and the recognizer 4000. The status file 14 indicates the percentage of the wave transformation completed at any given time and error codes in the case of abnormal termination. The user may request that the recognizer 4000 process be aborted, in which case the user interface 16 deletes this file, causing the recognizer 4000 process to stop. The tempo file 22 indicates when each beat of the music recorded in the wave file occurs. It is recorded in the user interface 16. The other system components shown in FIG. 2 include a keyboard 15, batch file 18, log file 19, a display monitor 17, and a file editor 20. The keyboard 15 is any standard device used for inputting instructions from the user 21 to the user interface 16. The user interface 16 creates and edits the profile 13, launches the recognizer 4000, indicating the name of the profile 13 to use, reads and displays recognition statuses from the status file 14 at regular intervals, deletes the status file in response to a user abort request, accepts user inputs from the keyboard 15, displays information to the user on a display monitor 17, runs in batch mode based on commands in a batch file 18, and optionally writes results of wave file note recognition to a log file 19. The display monitor 17 comprises any standard device for displaying information from the user interface 16 to the user 21. The batch file 18 is a flat text file containing operating system shell commands to automatically run the recognizer 4000 a number of times without attention. The log file 19 is a flat text file containing the result codes from the recognizer 4000 along with the profile names and time stamps. The file editor 20 comprises software that creates, edits, and displays flat text files, such as the batch file 18 and the log file 19. The file editor 20 accepts user input from the keyboard 15 and displays information on the display monitor 17. The user 21 is the person which interacts with the user interface 16 and file editor 20 via the keyboard 15 and display monitor 17.

In accordance with a preferred existing embodiment, the recommended minimum system requirements include (but may vary):

- a 486 processor or faster with 8M of memory;
- Windows® 95 or Windows® NT 4.0;
- a mouse or compatible pointing device;
- a 3.5" floppy drive to install the recognizer program 4000 or a CD-ROM drive;
- a Windows-compatible sound card, such as Sound Blaster, that supports recording of 16-bit wave files at 11025 Hz and plays MIDI files following the general MIDI standard;
- speaker or earphones;
- surge suppressor with electromagnetic interference (EMI) filtering (recommended when recording from an external source).

The instant invention may include some optional components for playing MIDI files, including:

- MIDI interface;
- MIDI instrument; and
- CD-ROM drive for playing audio CDs.

The hard drive space required for running the wave file to MIDI converter, i.e., recognizer 4000, is 6M.

In addition, the hard drive needs space to store the wave files 5. This can be substantial, depending on the number, time length, and format of these files.

The instant invention 4000 ascertains which frequencies or notes are present in the input signal by looking at one chunk or sample at a time. Referring to FIG. 1, the instant invention 1000, converts the audio input signal from analog to digital and creates a wave file 5. The wave file 5 is divided into the chunks, called window samples. The size of the sample window may be manually set or set to a default value. The default value is preferably the wave length of the lowest note being examined times the lowest note number divided by 6. This provides the longest window for insuring that the lower notes can be fully captured and examined, since lower notes have longer wavelengths. The window sample default may be set to other reasonable values, so long as the wave file captured may be fully examined. By contrast, a sample window in the prior art must be at least the size of the aggregate wave form's wave length and be a multiple of it. The instant invention, however, does not require that the sample window be based on the wave length of the aggregate wave form. Instead, the instant invention bases the window size on the wave length of the sine wave being subtracted from the aggregate wave form. This is a preferred method since it provides a controllable parameter and a parameter which may be changed by the user. For each sample window, sine waves are taken from a pre-configured sine wave table which is loaded during system initialization. The sine waves are precalculated and in digital form and are individually subtracted from each window sample to arrive at a correlation score. The lower the score, the better, whereby zero represents an ideal score.

Figure 3A:
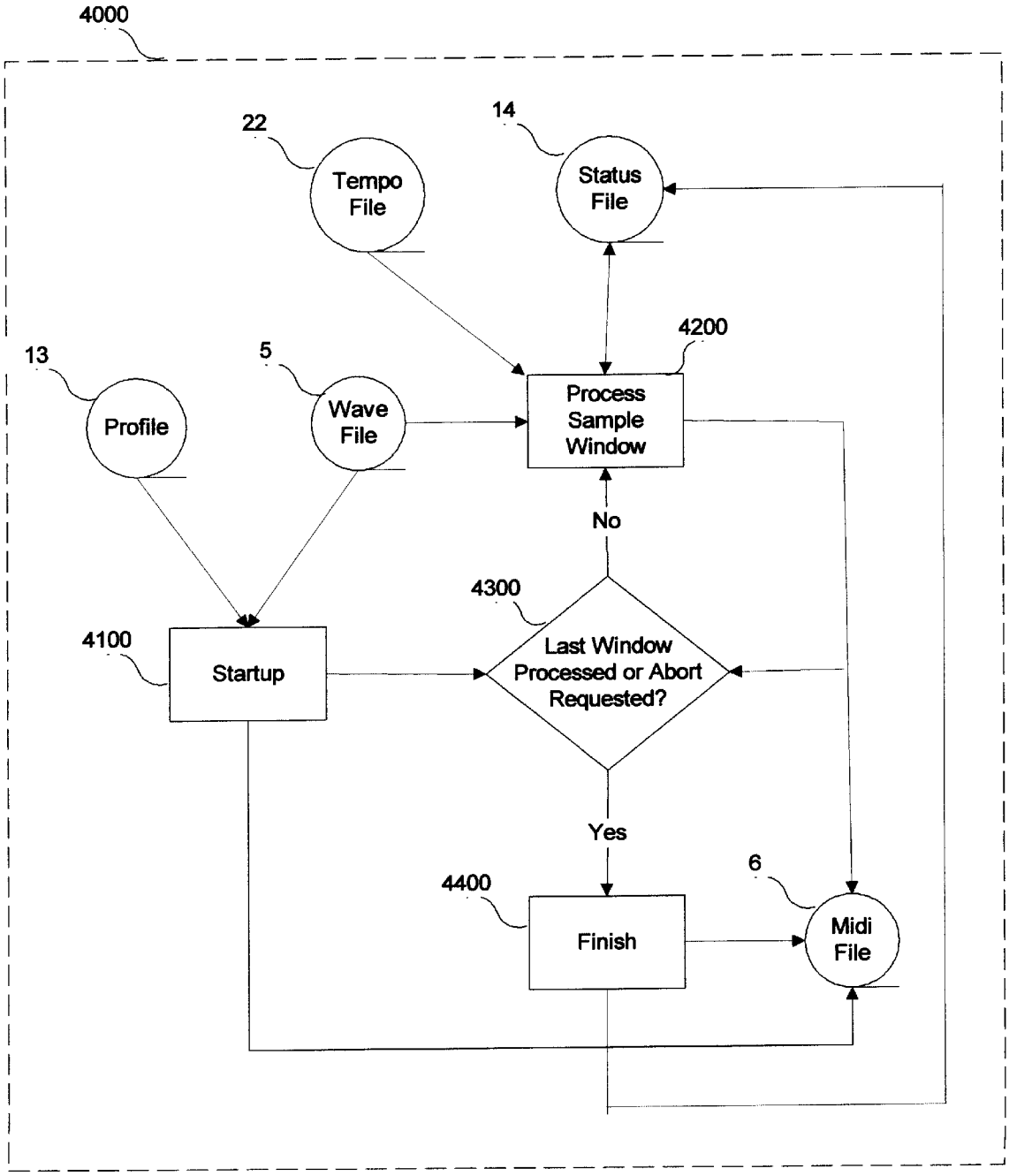
FIG. 3*a* is a flow diagram of the instant invention, illustrating the basic flow of the instant invention as it processes sample windows and creates a MIDI file.
Figure 3B:
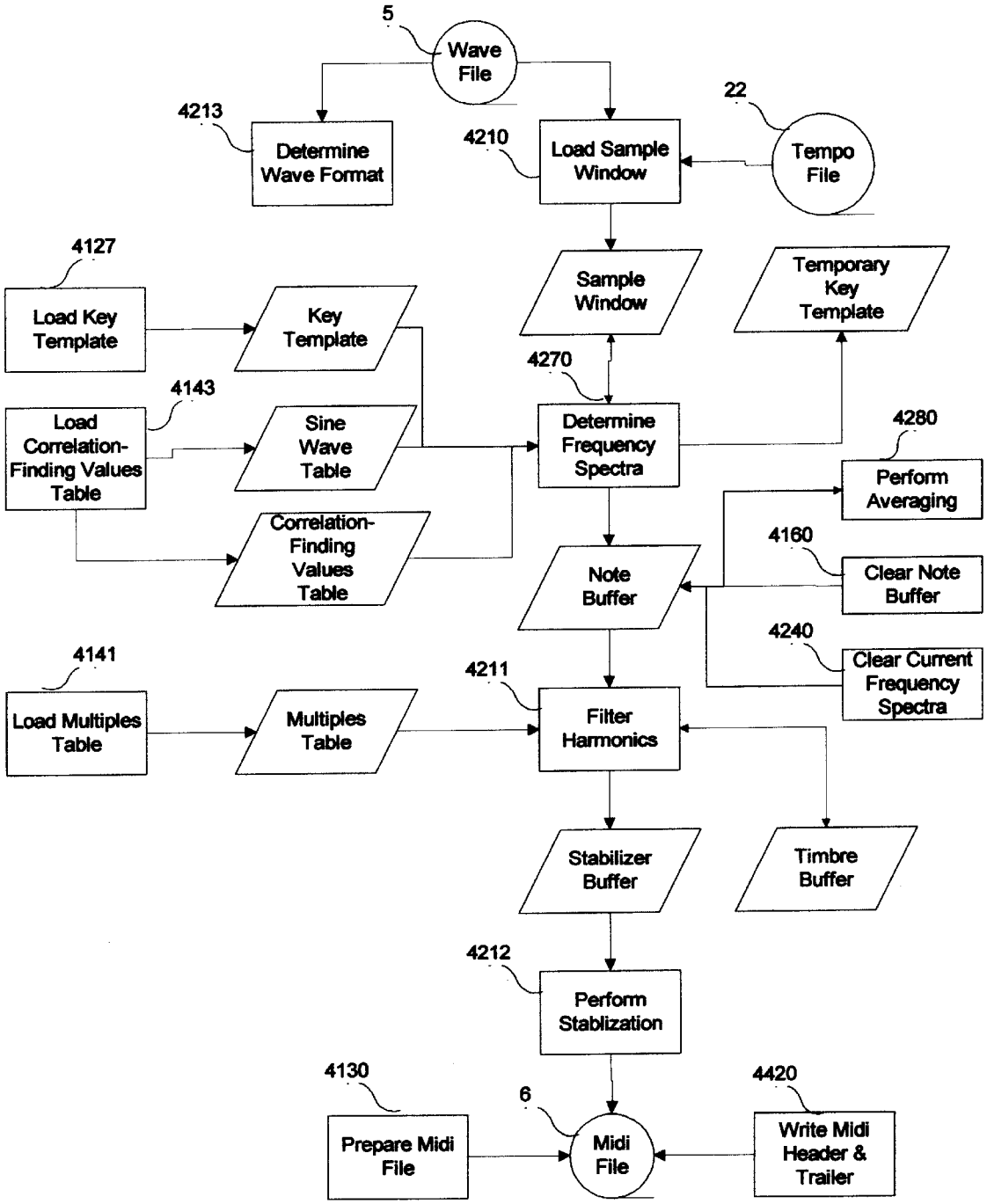
FIG. 3*b* is a high-level flow diagram of the instant invention illustrating the flow of data through the system.
Figure 4:
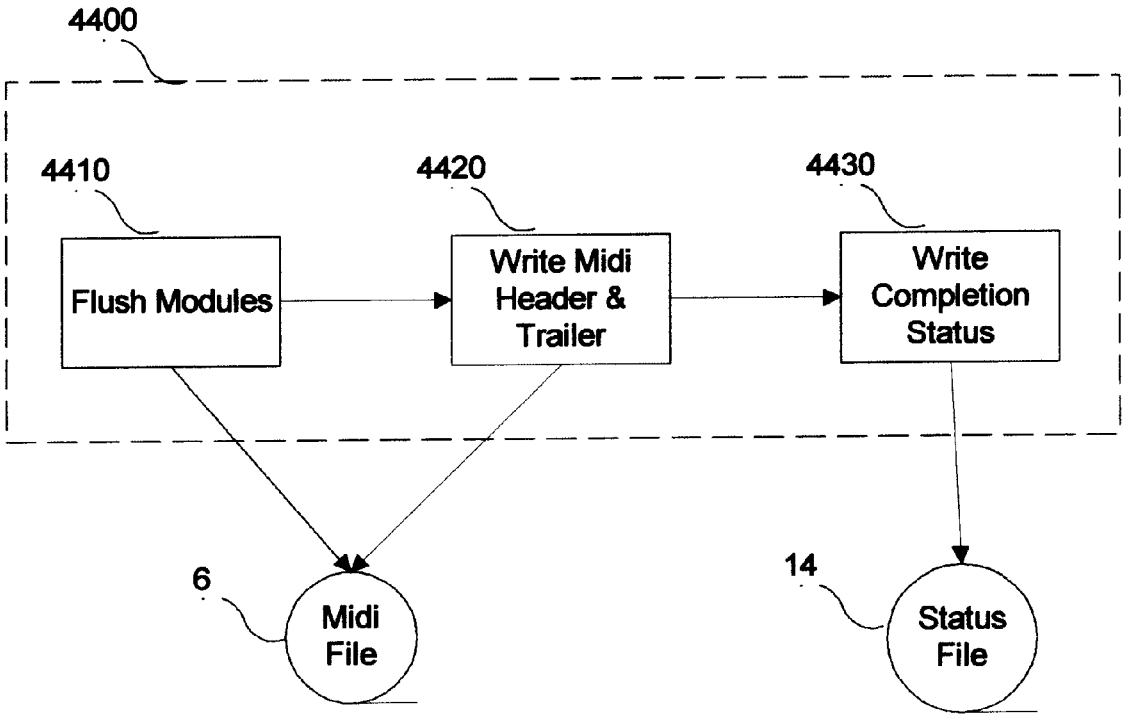
FIG. 4 is a flow diagram of the finishing sequence of the instant invention, illustrating how it processes information from the last sample window and completes the MIDI file.

With reference to FIG. 3, an overall system flow diagram of the recognizer 4000 is shown. The recognizer 4000 first performs startup 4100, wherein it prepares tables, modules, and files, and gathers information from the profile 13 and wave file 5 for use in processing the sample windows. The recognizer 4000 continually loops through a decision process where it checks to see if the last window has been processed or if an abort request has been made 4300. If the answer is no, the routine 4000 begins the next sample window processing 4200. During processing, the recognizer 4000 communicates with the status file 14 to facilitate communication between the user interface and the recognizer 4000. It reads the wave files and tempo file 22 to obtain the current sample window. As each sample window is processed, MIDI events are stored in the MIDI file 6. Once the last window has been processed or an abort has been requested, the finish routine 4400 processes information from the last sample window and completes the MIDI file. The finish sub-routine 4400 is shown in FIG. 4. The finish sub-routine 4400 flushes the modules by performing the averager, harmonic filter and stabilizer processes, as discussed in the optimization section. The finish routine 4400 then writes the MIDI header and trailer information by writing standard trailer byte values to the end of the MIDI file and the header specifying tempo, time signature, and key signature, instrument patch setting, and file length. The write completion status 4430 writes error or completion codes to the status file 14.

Figure 5:
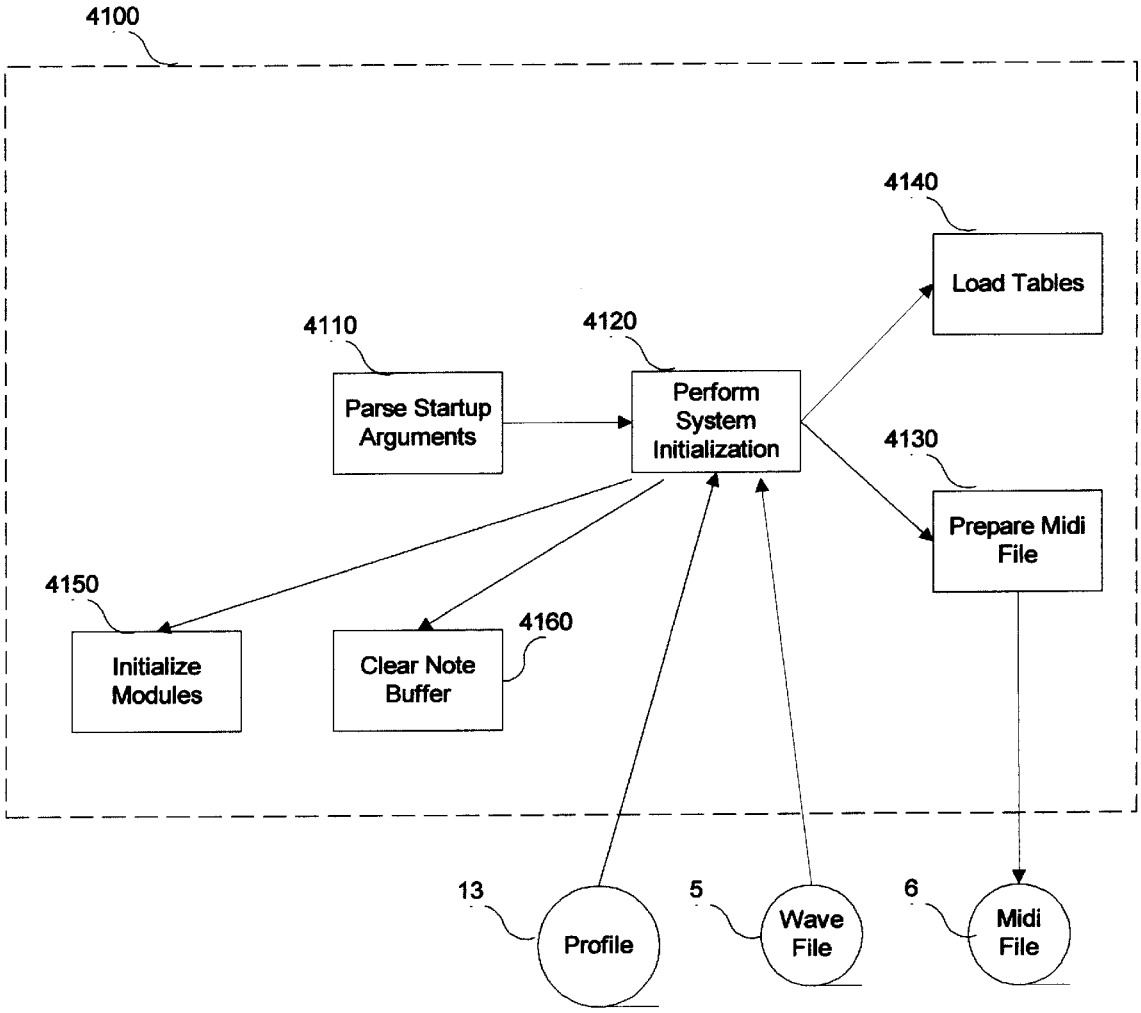
FIG. 5 is a flow diagram of the startup sub-routine of the instant invention, illustrating the preparation of tables, modules, and files, and information gathering from the profile and wave file for use in the sample window processing.
Figure 6:
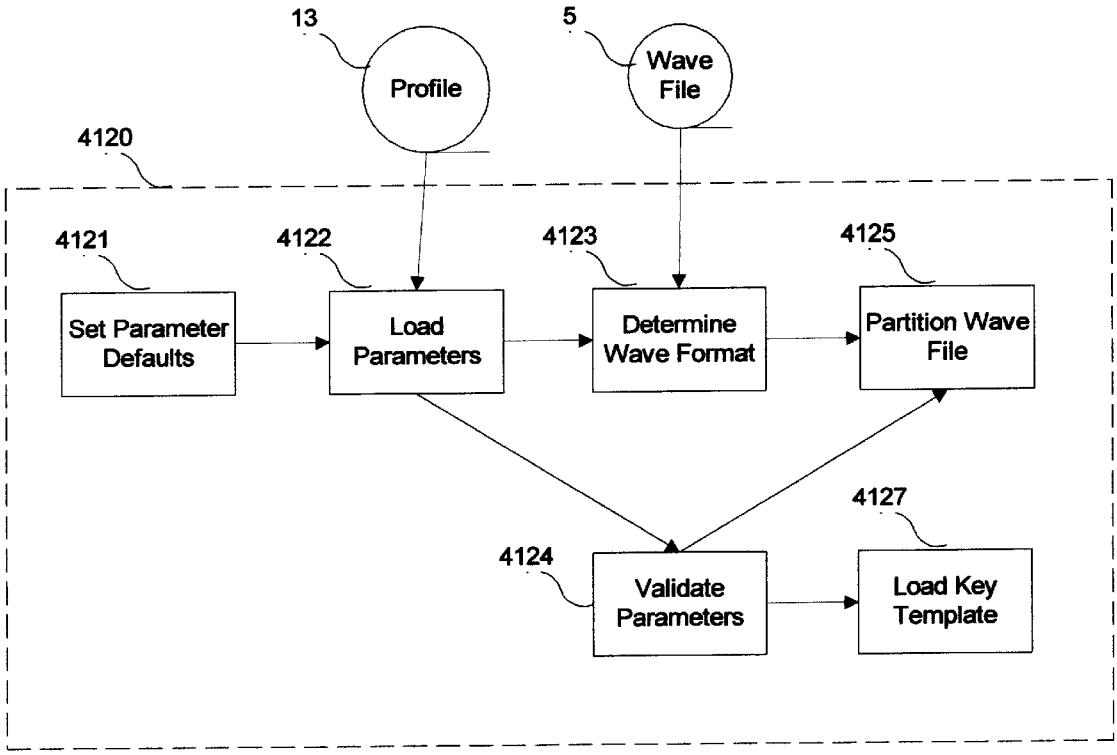
FIG. 6 is a flow diagram of the system initialization sub-routine of the instant invention, illustrating the setup of parameters which affect the recognition process, as well as the values derived from those parameters.

Referring to FIG. 5, the startup routine 4100 is shown in a flow diagram. The parse startup argument routine 4110 extracts the names of the profile and status files to be used. These are specified by the user interface 16 when launching the recognizer 4000. System initialization is then performed 4120. The system initialization sets parameters affecting the recognition process, as well as values derived from these parameters. The system initialization 4120 runs the initialize modules routine 4150, clears the note buffer 4160, loads the tables 4140 with precalculated values, and prepares the MIDI file 4130 for writing MIDI events. Referring to FIG. 6, a more detailed flow diagram of the system initialization 4120 is shown. Parameters are set to default values 4121 that affect the recognition process. These are to be used unless values for specific parameters are specified in the profile 13. Values for specific parameters that affect the recognition process are obtained from the profile 13, if they exist, during the load parameter routine 4122. To determine the wave format 4123, the recognizer 4000 reads the header of the wave file 5 to determine the number of tracks (mono or stereo), sample rate, number of bits per sample, and the total number of samples in the file. If no header information exists, the recognizer 4000 expects this information to be obtained from the profile 13. System initialization also includes the validation of parameters 4124. In the validate parameters routine 4124, the parameter values obtained from the profile 13 are checked to insure that they are within logical and practical limits. If not, a valid value is substituted, depending upon whether the obtained value is above or below established limits. In the partition wave file section 4125, the portion of the wave file 5 between the starting and ending times specified in the profile 13 is divided into a series of time slices, or sample windows. The number of samples in each window, i.e., the sample window size, is obtained from the profile 13. If the profile 13 does not indicate a sample window size, then a default value is used. The default sample window size is preferably the wave length corresponding to the lowest note times the lowest note number divided by six (6). The interval between the start of one window to the next corresponds to the note duration resolution and tempo specified in the profile 13. The sample windows may overlap or there may be a gap between them containing samples to be ignored, depending on the same window size and note duration resolution parameters. Routine 4127 loads the key template. That is, a table is created containing a flag for each note within the specified note range. The flags are set specifying which notes are within the key specified in the profile 13 if the constrain to key feature is enabled. If not, all of the flags are set. If the constrain to key feature is enabled, this may allow the recognizer 4000 to check only those notes which are believed to be present without wasting time and memory checking notes outside the specified key range.

Figure 7:
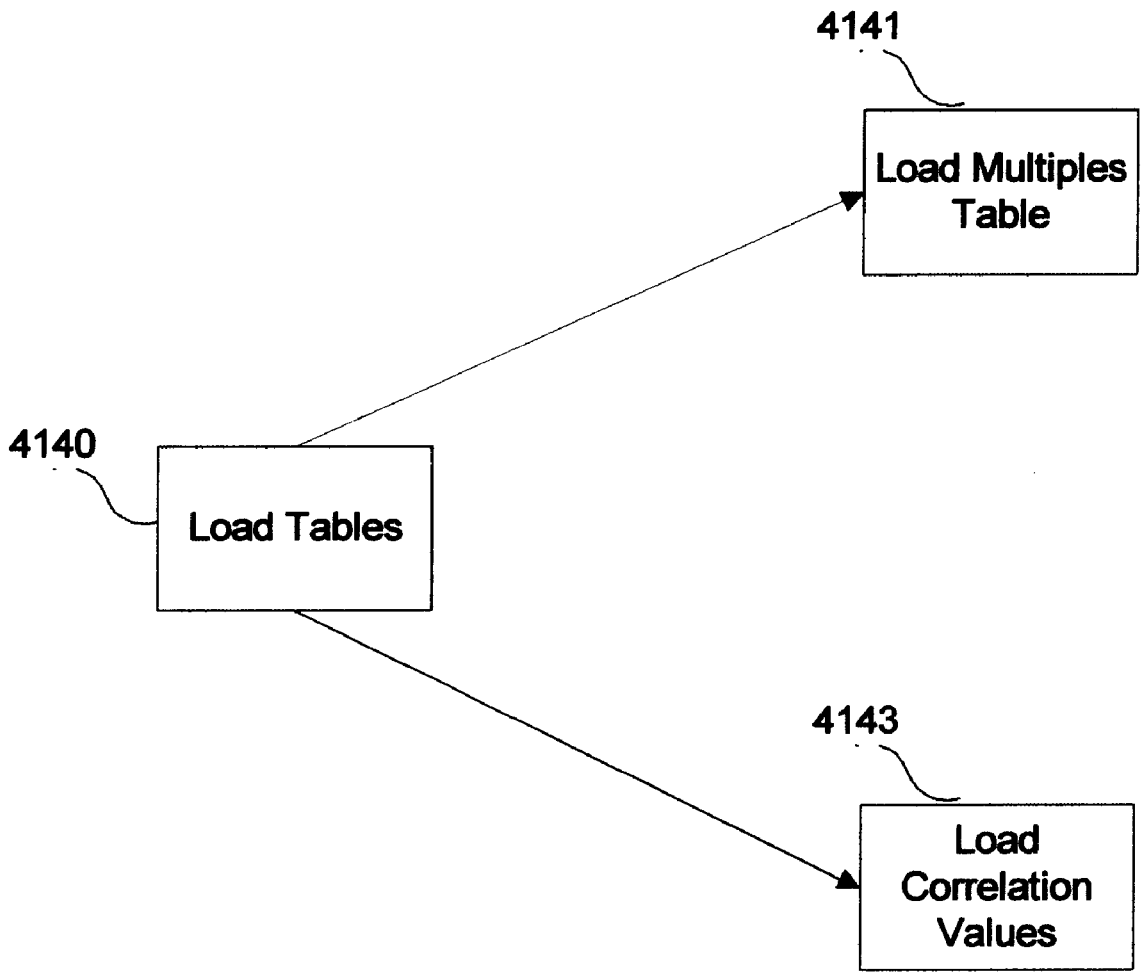
FIG. 7 is a flow diagram of the load tables' sub-routine, illustrating the tables which are populated with calculated values prior to performing the wave file to MIDI file conversion.

With reference to FIG. 7, the load table routine 4140 is shown. It precalculates values, that do not change, to save time. The tables which are loaded by this routine 4140 include the multiples table 4141 and the correlation finding values table 4143. The multiples table 4141 contains a series of note numbers corresponding to multiples for each note in the note range. It is used to identify potential harmonics in the harmonic filter 4211 of FIG. 9. The sine wave table is loaded with sine functions, one corresponding to the frequency of each note in the note range. It is used to find the best correlation score for each note as shown at 4272 of FIG. 9. The number of values in each series is determined by multiplying the wave length of the lowest note by a fixed number, preferably five. This eliminates the need for interpolating in between values when the sine wave table is used.

The correlation finding values 4143 includes values corresponding to a quarter of the wave length of each note in the note range. A quarter wave length is added to each end of the sample window to allow phase adjustments when finding the best correlation score for each note when checking phase. The table 4143 is also used to calculate the size of the phase increment, and the value is scaled so that every sine wave can handle the same number of phase increments regardless of frequency.

Figure 8:
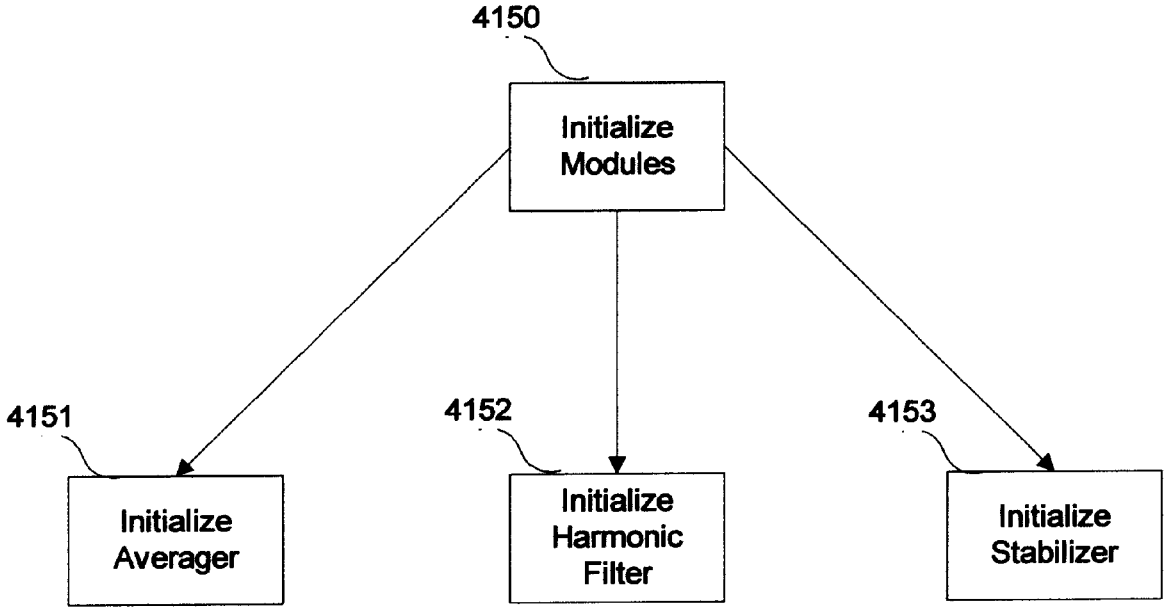
FIG. 8 is a flow diagram of the modules' initialization sub-routine, illustrating the modules initialized during system initialization.

With reference to FIG. 8, the module initialization routine 4150 is shown. The module initialization routine 4150 prepares values used internally by various modules for sample window processing. The initialized averager routine sets the counter to zero and the flag representing the previous wave sample level is set to below threshold. These are the default values for the averager. The table for holding the amplitudes of the previous sample window's fundamental notes is cleared when initializing the harmonic filter 4152. When initializing the stabilizer 4153, delta time is set to zero and the stabilizer table is cleared for each note in the note range. Delta time corresponds to MIDI ticks, that is, the unit of time used in MIDI files. The period between ticks is determined by the note duration resolution and tempo specifications in the profile 13. Then, each note's counter is set equal to the minimum note length specified in the profile 13. The note buffers are cleared for every note within the note range.

Figure 9:
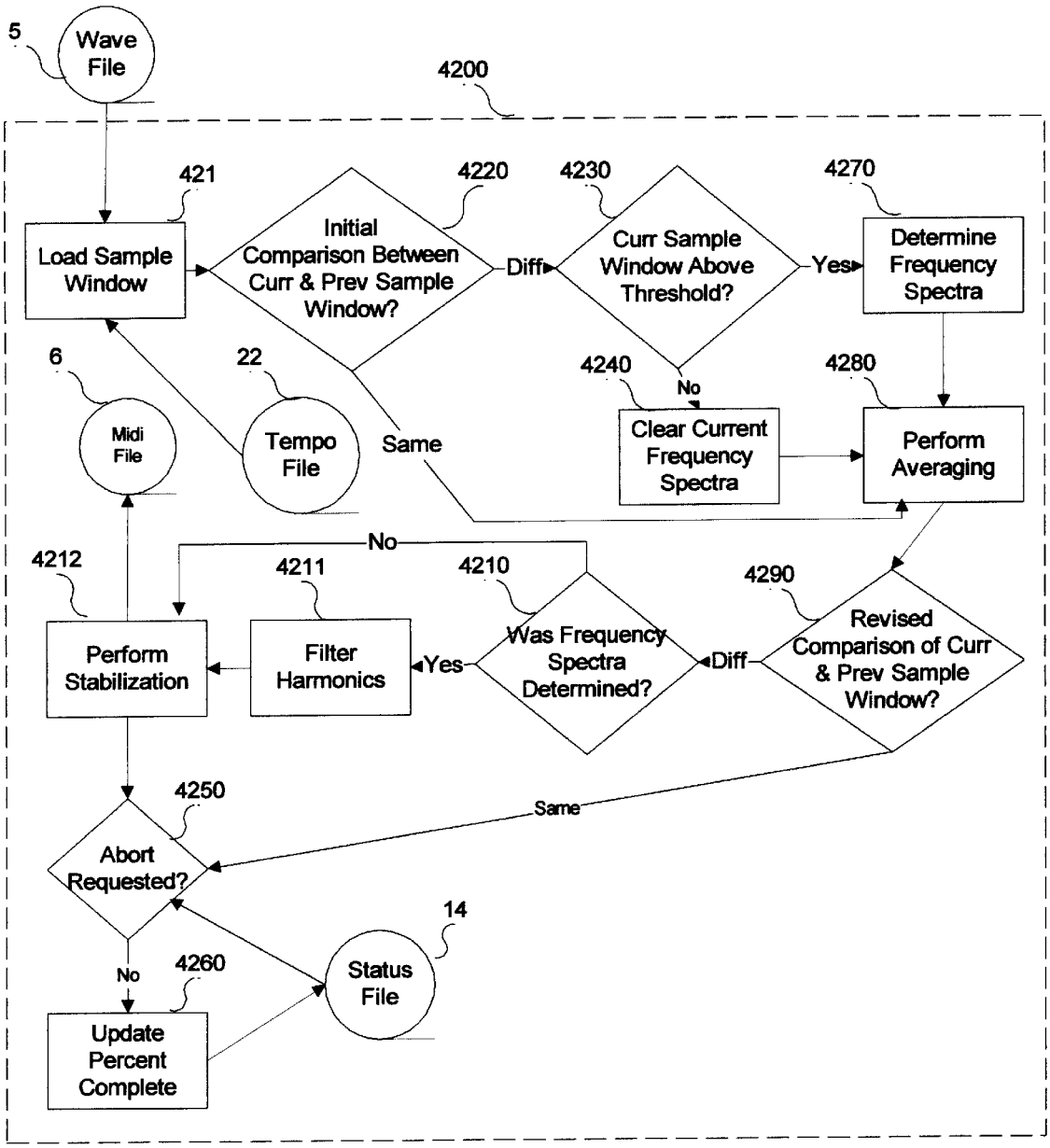
FIG. 9 is a flow diagram, illustrating the sub-routines comprising the wave file to MIDI file converter performed for each sample window of the instant invention, including the load sample window sub-routine, successive sample window comparison sub-routine, a sample window threshold sub-routine, a frequency spectrum sub-routine, the averaging sub-routine, the harmonic filter sub-routine, the stabilization sub-routine, and the MIDI file created by the foregoing sub-routines.
Figure 10:
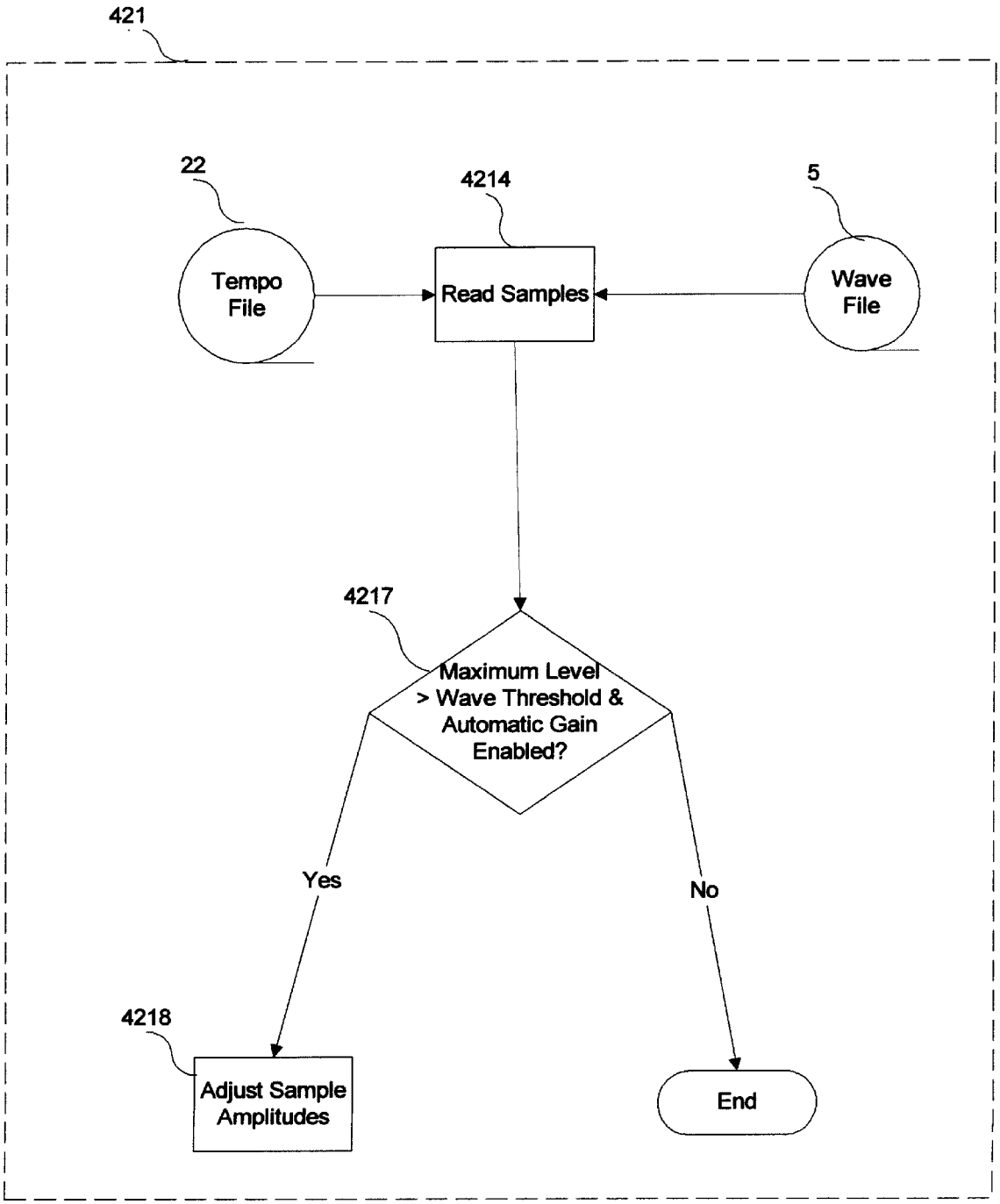
FIG. 10 is a flow diagram of the sample window loading sub-routine of the wave file to MIDI file converter of the instant invention, illustrating higher level sub-routines, such as the cluster detection enabling sub-routine and threshold detection.

The heart of the recognizer 4000 is illustrated in FIG. 9. The process sample window routine 4200 processes sample windows from the wave file one at a time from the start time to the ending time within the time range. Detected musical information is written to the MIDI file 6. First, a sample window is loaded 421, and values for the current sample window are gathered and scaled to remove variations caused by the particular wave format [such as sample rate, number of tracks and bit resolution]. The load sample window routine 421 is shown in more detail in FIG. 10. The starting position of data to be read from the wave file and loaded into the same buffer is read from the tempo file 22, which indicates where the beats fall in the wave file. In the absence of the tempo file, the separation between the start of each sample window is constant and based on the tempo specified in the profile 13. Samples are read from the wave file and loaded into the sample window buffer. If the wave file is an 8-bit sample resolution, the samples are scaled up to 16-bit resolution. If the wave file is in stereo, both tracks are added together into one track, weighted according to the stereo balance specified in the profile 13. Samples are skipped as necessary to reduce the actual sample rate of the wave file to the effective sample rate specified in the profile 13. The load sample window routine checks for whether the maximum level of the samples in the current sample window is greater than the wave threshold and determines whether the automatic gain has been enabled. The maximum level and wave threshold comparison checks to determine whether the absolute value of the sample in the sample window farthest from the zero is greater than the wave file threshold specified in the profile 13. It also checks to see if the automatic gain feature has been enabled. If the maximum level is greater than the wave threshold, and the automatic gain has been enabled, then the sample amplitudes are adjusted 4218. All samples in a sample window buffer are proportionately scaled so that the sample with the maximum level is set to the highest possible value allowed for 16-bit sample resolution.

Referring to FIG. 9, after the load sample window routine has been run, an initial comparison is made between the current and previous sample windows 4220. The absolute value of the maximum level (before applying automatic gain) in the current sample window is compared to the absolute value of the maximum level in the previous sample window. If both are above the wave file threshold and the pause between notes feature is specified in the profile 13, the two sample windows are considered to be the same. If both are above the wave threshold but the pause between the note feature is not enabled, the sample windows are initially considered to be different. If both sample windows are below threshold, they are considered the same. If just one of the windows is below threshold, then they are initially considered to be different. If they are different, then the process sample window routine 4200 determines whether the current sample window is above threshold 4230. To determine whether the current sample window is above threshold, the absolute value of the maximum level (before applying automatic gain) in the current sample window is checked to see if it is above the wave file threshold specified in the profile 13. If it is, then the frequency spectra is determined 4270. If not, the current frequency spectra determined for the previous sample window is cleared 4240. When clearing the current frequency spectra, the note buffer and current values in the stabilizer buffer are cleared for every note within the note range 4240. After the current frequency spectra has been cleared in step 4240, then the averaging routine 4280 is activated.

With reference to FIG. 11, the frequency spectra is determined in sub-routine 4270 by finding all frequencies corresponding to notes within a note range that are present in the current sample window, along with the amplitudes thereof. Notes are examined in sequence from the minimum to maximum note in the note range. The frequency spectrum routine 4270 first determines whether the current note is present in a temporary copy of the key template 4271 so that only notes within a specified key are examined if the constrain to key feature is enabled. Next, the best correlation at the current note is determined 4272. To find the best correlation of the current note, the correlation between the sample window and values in the sine wave table for the current note are calculated, while shifting the table values for various phases and scaling the table values for various amplitudes. The purpose is to find the best amplitude-phase combination of sine waves which yields the closest correlation to the sample window.

Since each sine wave has the properties of frequency, amplitude, and phase, phase and amplitude must be determined and accounted for when subtracting sine waves from the aggregate wave form. Ideally, the invention looks at each frequency corresponding to musical notes within the specified range. Any note range can be defined within the MIDI specification. For instance, all the keys on a piano may be used for selecting sine waves to subtract from the aggregate wave form. All the frequencies examined comprise the sine wave table. The instant invention, however, is designed so that every frequency in the sine wave table does not have to be examined. To process every frequency, such as in a domain set comprising the keys of a piano, would require numerous calculations which would slow the program down and eat up memory. For example, the invention may just process frequencies within a specified key or in a predetermined note range. The instant invention skip samples to increase the rate of the program.

Figure 12:
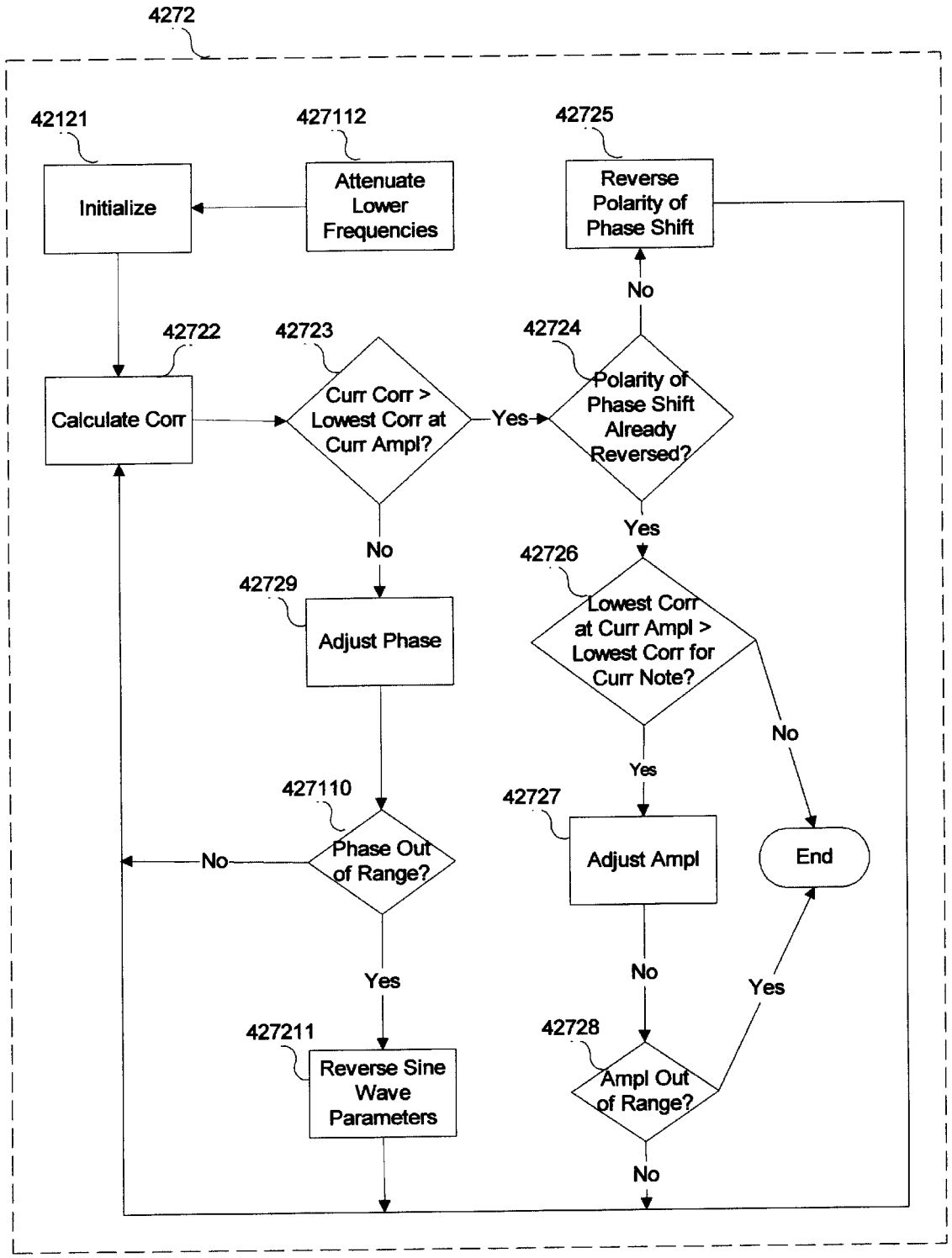
FIG. 12 is a flow diagram of the note correlation sub-routine, which finds the best correlation for each frequency in accordance with the wave file to MIDI file converter of the instant invention.

With reference to FIGS. 12 and 20, the routine for finding the best correlation at the current designated note is shown and referenced by 4272.

When low and high frequencies exist concurrently in a wave file, the lower frequencies often obscure the higher frequencies so that they may be detectable using the correlation score process.

The solution is to employ digital filtering to remove the lower frequencies 427112. Different filters are combined to attenuate lower frequencies as much as possible with a minimum of cascading and extra samples that need to be examined before and after the sample window. The formulae are shown on FIG. 22. Filter A (typically called a low-pass filter) is set with the center frequency one octave below (half) the frequency we are interested in detecting. Filter B (typically called a high-pass filter) is set with the center frequency at the frequency we are interested in detecting. The center frequencies are set by changing the apparent sample rate by adjusting the sample interval between the three samples used as inputs for each iteration of the formulae. By combining the two filters algebraically according to the following equation, the best of both filters is obtained:

$$Z_n=(-X_{n-3L}+2X_{n-2L}-3X_{n-L}+4X_n-3X_{n+L}+2X_{n+2L}-X_{n+3L})/16.$$

where:

x=set of samples in the current sample window before filtering;

n=member within the set of samples;

L=sample rate/frequency/2; and

Z=set of samples in the current sample window after filtering.

Figure 22:
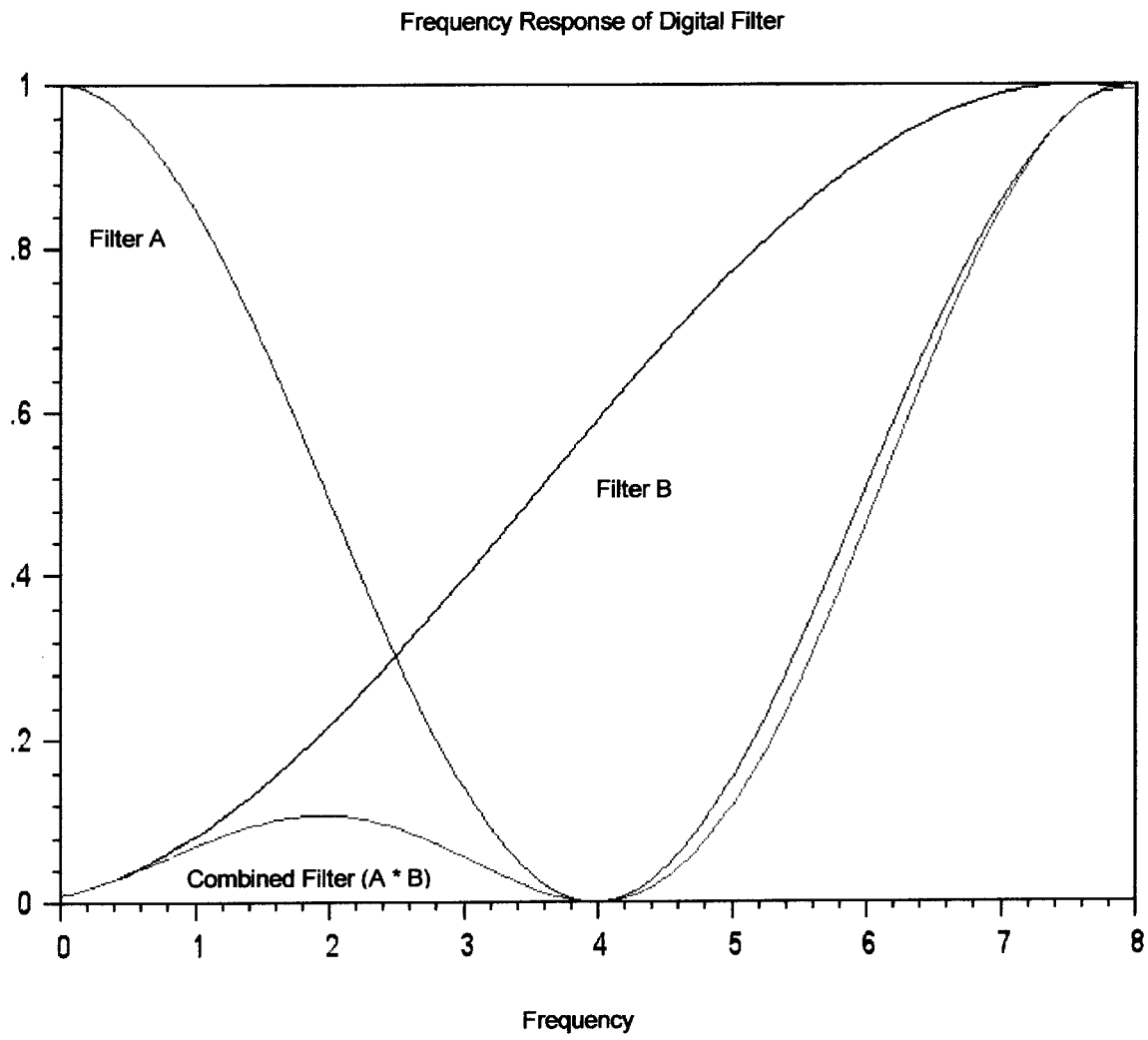
FIG. 22 depicts the Frequency response resulting by the application of a digital filter that attenuates lower frequencies.

Correlation scoring is performed on the resulting waveform. The individual and combined frequency response curves are shown in FIG. 22.

For each frequency examined when compared to the aggregate wave form, a series of calculations are done where selected sine waves are subtracted from the sample aggregate wave form. When making these calculations, the amplitude and phase of the sine wave are shifted to determine at which point the best score may be obtained.

First, initialization occurs at 42721. The initialization routine 42721 sets the current amplitude to zero, sets the current amplitude polarity to positive, and sets the amplitude increment to that specified in the profile 13. It also sets the current phase to zero, the current phase polarity to positive, the phase increment to the quarter wave value from the correlation-finding values table corresponding to the current note divided by the phase increment specified in the profile 13. Next, the correlation is calculated at 42722. To calculate the correlation value, each value from the sine wave table corresponding to the current note is shifted by the current phase and multiplied by the current amplitude. It is then subtracted from the corresponding value in the current sample window and the difference is squared. The results for each pair of values are summed together. When the aggregate window is compared to a sine wave at a particular amplitude and phase, pairs of samples can be skipped by setting a buffer increment. For example, if the sample buffer size is 10,000 and the buffer increment is set to 2, only 5000 pairs of samples would actually be compared. This speeds the calculation and improves accuracy. Skipping samples reduces the effective sample rate. The buffer increment can be set manually in the profile, otherwise it is set automatically. The maximum allowable buffer increment is set to the integer that would result in the lowest Nyquist frequency (sample rate divided by 2) that is not lower than the frequency of the highest note in the note range. For example, if the sample rate is 8,000 Hz and the frequency of the highest note is 700 Hz, the maximum buffer increment would be 5. This value would reduce the effective sample rate to 1600 Hz, resulting in a Nyquist frequency of 800 Hz, just above 700 Hz. By default, the buffer increment is set halfway between this maximum and the minimum of 1.

This leads to decision block 42723 which determines whether the current correlation is greater than the lowest correlation at the current amplitude. If the answer is in the affirmative, then the correlation routine 4272 determines whether the polarity of phase shift has already been reversed at 42724 within this run of 4272. If not, the polarity of the phase shift is reversed 42725 and the correlation value is calculated again 42722. If the polarity has already been reversed, then the correlation routine 42722 determines whether the lowest correlation at the current amplitude is greater than the lowest correlation for the current note 42726. If not, then the correlation routine 4272 ends. If the lowest correlation at the current amplitude is greater than the lowest correlation for the current note then the amplitude is adjusted 42727. To adjust the amplitude, the amplitude increment is multiplied by the current amplitude polarity and is added to the current amplitude. After adjusting the amplitude at 42727, the correlation routine 4272 determines whether the absolute value of the amplitude has exceeded the maximum value allowed by the MIDI standard 42728. If it has fallen out of range, then the correlation routine 4272 ends. If not, the next correlation calculation is performed 42722. Returning to decision block 42723, if the current correlation is not greater than the lowest correlation at the current amplitude, then the phase is adjusted 42729 by adding the phase increment multiplied by the current phase shift polarity to the current phase. The program 4272 determines whether the absolute value of the phase has fallen out of a predetermined range 427110. The limit of the range is a quarter wavelength. If not, the next correlation calculation is performed 42722. If the phase has fallen out of range, then the sine wave parameters are reversed 427211. The polarity of the current amplitude is reversed, the amplitude increment polarity is reversed, and the current phase is shifted by half a wavelength. Consequently, the recognizer 4000 when performing calculations in the correlation routine 4272 maintains internal discriminators which determine whether changes in the phase and amplitude combination for the sine waves are improving the correlation score. It follows the trend to find the best correlation while examining the least number of phase-amplitude combinations. This has been determined to eliminate unnecessary steps and calculations to save time and memory and to arrive at the best correlation more quickly. Once the correlation routine 4272 has exhausted its examination of the current note, the recognizer 4000 returns to the frequency spectrum routine 4270.

Figure 17:
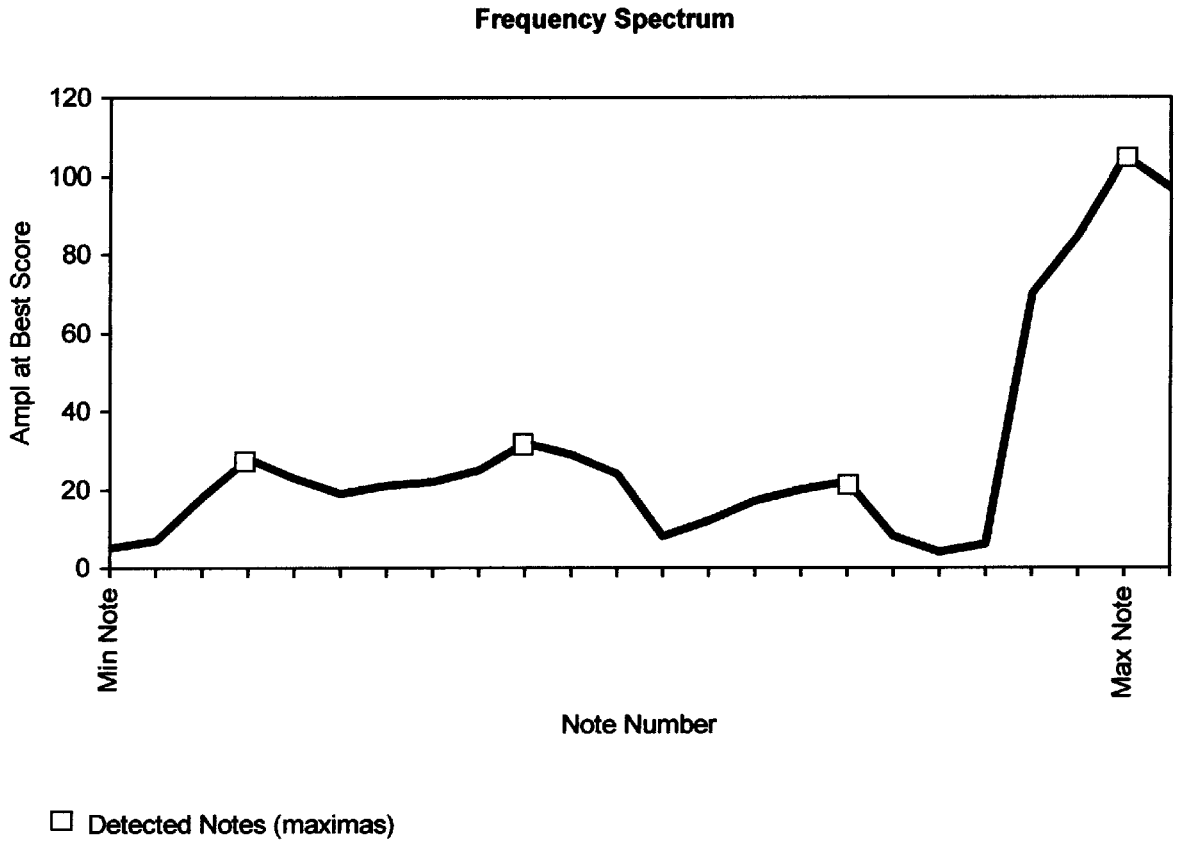
FIG. 17 is a graph illustrating the maximas, i.e. amplitudes at the best correlations found in a frequency spectrum.
Figure 18A:
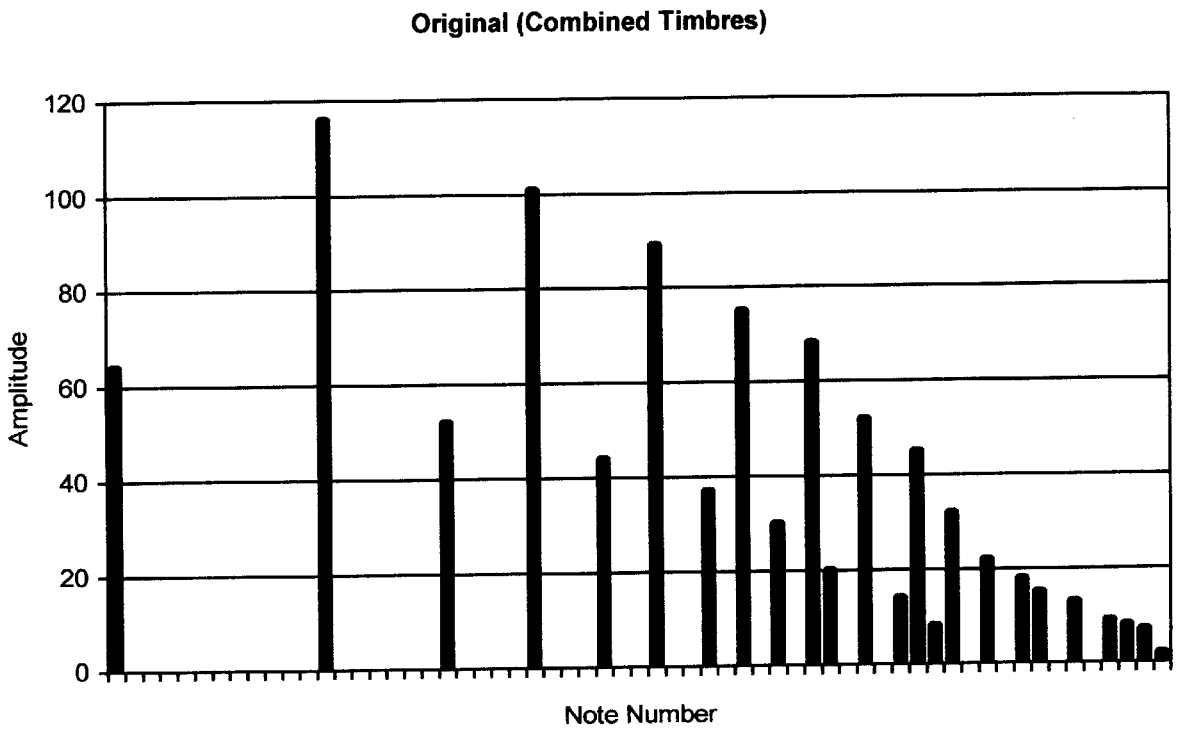
FIGS. 18*a–c* are graphs illustrating the harmonics that the harmonic filter detects from the frequency, the first fundamental and second fundamental.
Figure 18B:
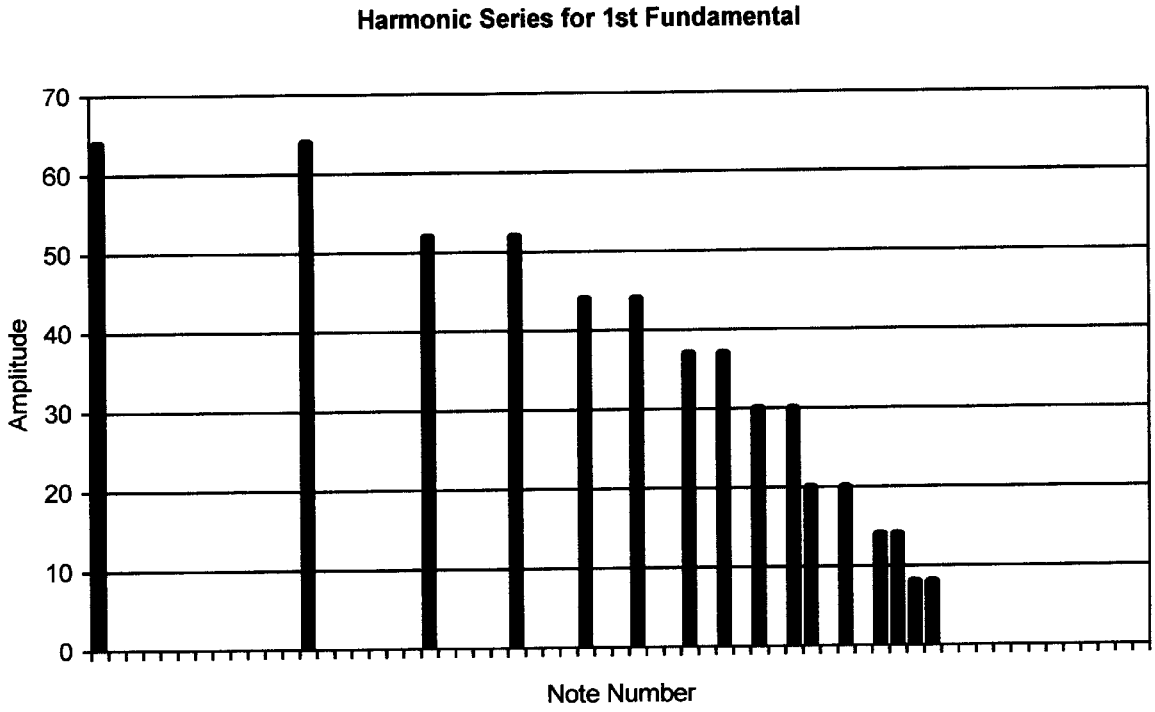
Figure 18C:
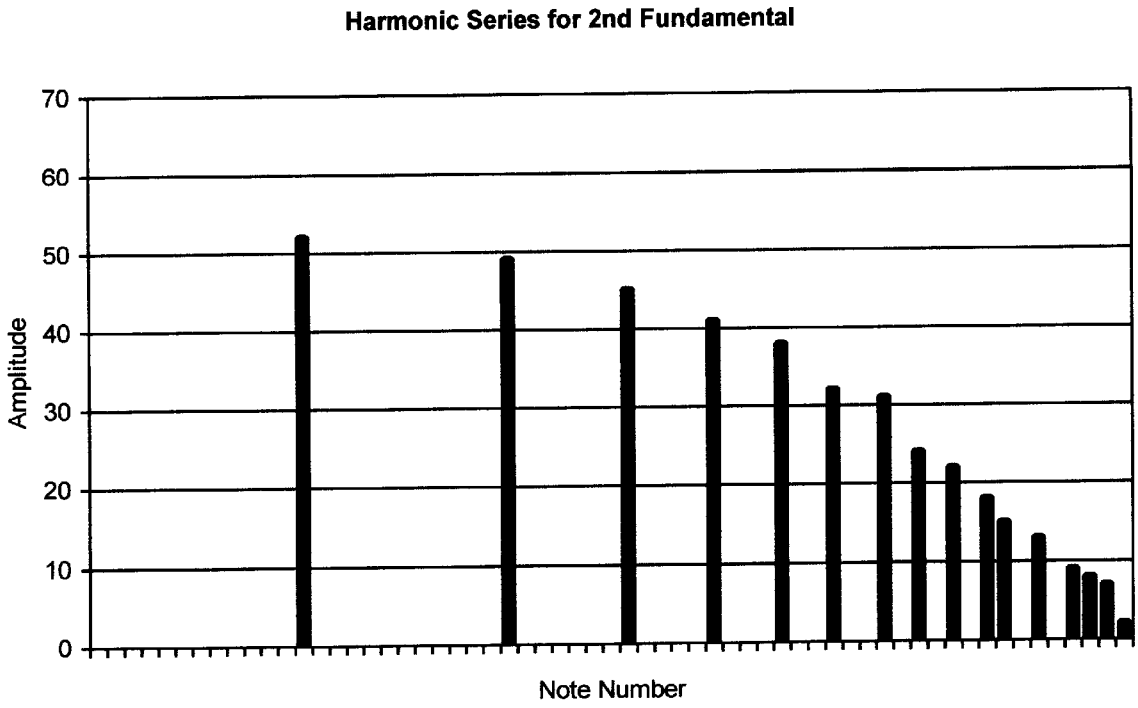

Referring to FIGS. 11 and 17, after finding the amplitude and phase resulting in the best correlation at the current note 4272, the frequency spectrum routine 4270 determines whether a amplitude maxima has been detected 4273. If the absolute value of the amplitude resulting in the best correlation for the current note is better (greater) than the absolute value of the amplitude resulting the best correlation for the adjacent notes, then an amplitude maxima exists for the current note. The amplitude maximas comprise notes which are believed to exist in the current sample window. If not, the frequency spectrum routine 4270 clears the amplitude in the note buffer 42710. The current note number is then incremented 42711, checked to see if it is outside the specified note range 42712 and then examined to see if it is in the temporary copy of the key template 4271. If the incremented note is within the note range and in the key, then it is examined by the correlation routine 4272 to find the best correlation for phase and amplitude as previously discussed with respect to correlation routine 4272. Thus, correlation values are calculated for each note at various phases and amplitudes to determine the lowest correlation value for each note. After performing these calculations, for each note, absolute values of the amplitudes resulting in the best correlation values are then compared to detect amplitude maximas. After the amplitude maxima is detected for a particular note of interest, the frequency spectrum routine 4270 inquires into whether cluster detection has been enabled 4274. If it has been enabled, then the current frequency for the note determined to exist in the sample window is cancelled. This is done by subtracting the sine wave with the amplitude-phase combination which resulted in the best correlation for the note from the sample window. Then the best correlation is re-calculated at the first frequency without the frequency present to find or obtain an adjusted score to compare with the adjacent frequency of interest. The best score of the second frequency and re-score of the first are then compared to determine if the second frequency would be a minima if the first frequency were not present. If it would be a minima, then it is determined that a second frequency is present in the sample window. If cluster detection is not enabled, then the current note is not cancelled. In either event, the amplitude for the current note is checked to see if it is greater than the MIDI threshold 4276. If the amplitude for the current note is zero then the amplitude in the note buffer is cleared 42710. If the current amplitude is above the MIDI threshold then the absolute value of the amplitude found to produce the best correlation for the note is used in the following equation:

$$|a| \times 2^{\left(\frac{k-63.5}{24}\right)} = \text{scaled amplitude}$$

which is written into the note buffer 4277; where:

a=amplitude found to produce the best correlation for the note; and

"k"=MIDI note number (where 60=Middle C)

Scaling the amplitude of the frequencies representing notes partially corrects for inequitable or disproportionate error margins, and is represented in FIG. 11 as 42713. The frequency spectrum program 4270 then determines whether the constrain-to-key feature is specified in the profile 13 and whether the previous note is present in the key template 4278. If the answer is yes, harmonics are added to temporary key 4279. As a result, notes corresponding to harmonic frequencies of the detected note will be examined even if these notes are not included in the selected key. That is the frequency spectrum program 4270 adds note numbers corresponding to multiples of the frequency corresponding to the note to the copy of the key template before incrementing the current note at 42711. If the answer is no, then the current harmonics are not added to the temporary key and the current note is incremented 42711. The new current note is then checked to see if it is outside the specified note range 42712. If it is, the frequency spectrum routine 4270 ends. If the new current note is within range, then it is checked to determine whether it is present in a temporary copy of the key template 4271. If it is, then the new current note is examined to find the best correlation value 4272, as previously discussed with respect to FIG. 12. As a result, the frequency spectrum routine 4270 and the correlation routine 4272 are repeated until all frequencies within the note range have been examined and all detected notes are written to the note buffer.

Returning to FIG. 9, once the frequency spectra has been determined in accordance with block 4270, the recognizer of the instant invention 4000 performs averaging in accordance with subroutine 4280. The averaging routine 4280 compares frequencies detected in the current window with those of the previous window to test the level of similarity. A similarity score is calculated and is compared to a sustain threshold specified in profile 13. If the fraction is above the sustained threshold, then the previous and current windows are considered the same, that is, the same set of frequencies are sustained between the two sample windows. If it is below the sustain threshold, then the windows are considered different, that is, they contain different notes from each other. The default sustained threshold is 0.60, but it may vary. The user can select the threshold, but if it is set too high then everything will look different, and if too low everything will look the same.

Figure 13:
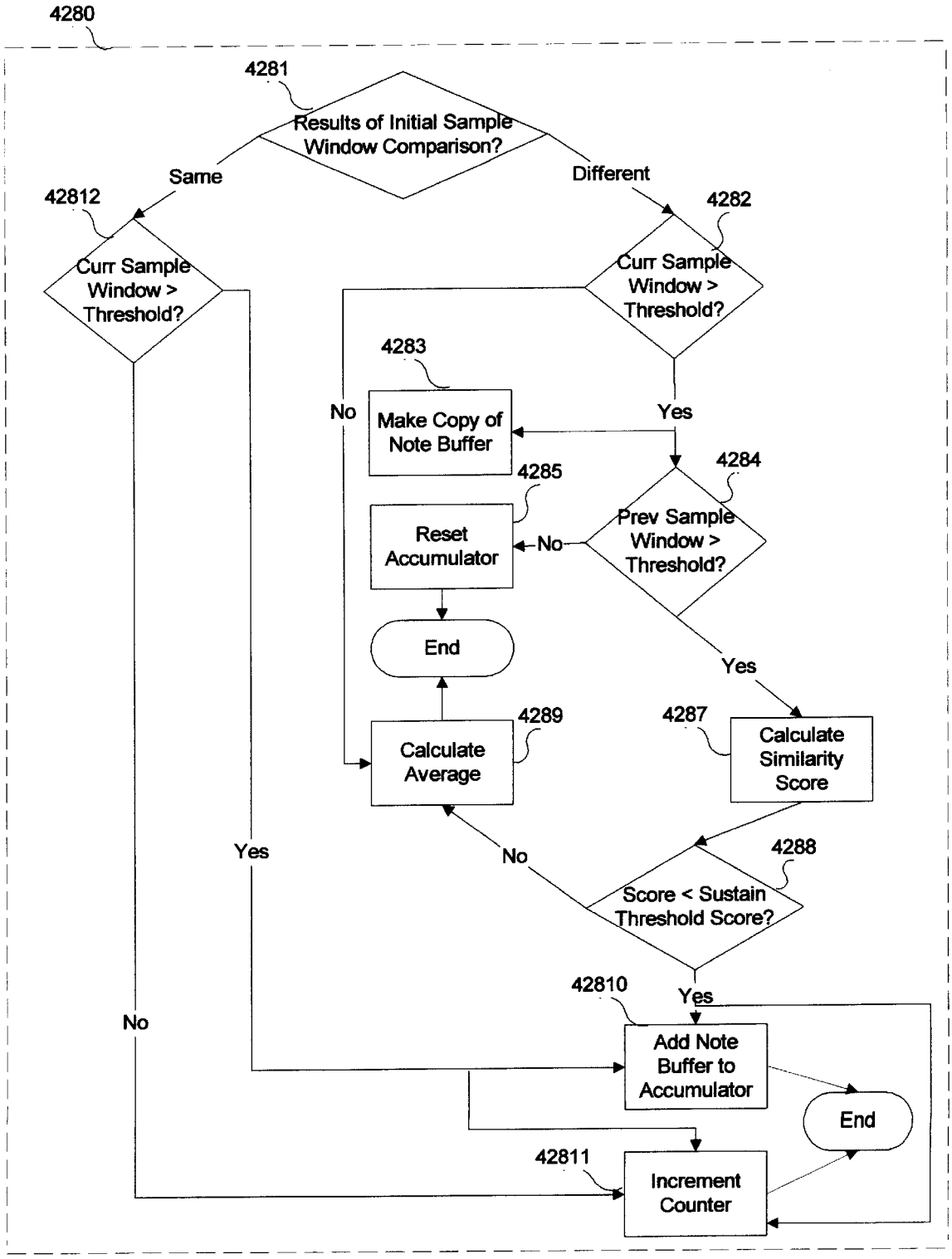
FIG. 13 is a flow diagram of the averaging sub-routine which tests the similarity between successive sample windows in accordance with the wave file to MIDI file converter of the instant invention.

With reference to FIG. 13, the averaging routine 4280 first compares the results of the initial sample window comparison as in 4220 to determine whether they are the same or different 4281. If the results of the initial sample window comparison are different the averaging routine 4280 determines whether the current sample window was above the wave threshold 4282 as in 4230. If it is above the wave threshold, a copy of the note buffer is made. The previous sample window is then checked to see if it is above the wave threshold 4284. That is the absolute value of the maximum level (before applying automatic gain) of the previous sample window is checked to see if it is above the wave file threshold specified in the profile 13. If not, the note buffer is copied to the accumulator buffer and the sample window counter is set to one 4285. Thereafter the averaging routine 4280 ends and returns to the sample window processing routine 4200. In the case where the previous sample window is above the threshold 4284, the similarity score is calculated 4287. The routine 4280 lines up the frequencies between the windows and compares the amplitude pairs at each corresponding frequency. The minimum and maximum amplitudes are isolated. The lesser amplitudes of each pair are added together and divided by the sum of the greater amplitudes of each pair. This results in a fraction between zero and 1. The score is then checked to see if it is less than the sustain threshold score 4288. If not, the current and previous sample windows are considered different, and the average of the amplitudes contained in the previous note buffers that were the same to each other are calculated 4289 and the averaging routine 428 ends. If the score is less than the sustained threshold score, the current and previous sample windows are considered the same, and the note buffer is added to the accumulator by adding the amplitudes in the note buffer to the amplitudes for the corresponding notes in the accumulator buffer. Simultaneously, the counter is incremented by adding one to the sample window counter 42811. Thereafter the averaging program ends and returns to the sample window processing routine 4200. Returning to the beginning of the averaging routine at 4281, if the results of the initial sample window comparison are the same then the current sample window is checked to see if it is above the wave threshold as in 4220. That is, the absolute value of the maximum level in the current sample window is checked to see if it is above the wave file threshold specified in the profile 13. If the current sample window is not above threshold, the counter is incremented 42811 and the averaging program ends. If the current sample window is above the threshold, the counter is incremented 42811 and the values in the note buffer are added to the corresponding values in the accumulator buffer 42810. Once the averaging routine has been completed, the recognizer 4000 returns to the sample window processing routine 4200.

Referring to FIG. 9, there are two instances where the averaging routine 4280 are performed without determining the frequency spectra 4270. If the initial comparison between the current and previous sample windows are the same 4220 then the sample window processing routine 4200 runs the averaging routine 4280 which also interprets the two sample windows as being the same. On the other hand, if the initial comparison between the current and previous sample windows are different but the current sample window is below the wave file threshold 4230, then the sample window processing routine 4200 clears the note buffer for every note within the note range 4240 and then runs the averaging routine 4280 which interprets the sample windows as being the same. When the averaging routine is completed, it returns a synchronization value representing the number of consecutive sample windows that were determined to be the same. This is required so that the MIDI file is in sync with the wave file. Once all averaging has been performed 4280, the sample window processing routine decides whether the current sample window is the same or different from the previous sample window 4290 based on the results in the averaging process 4280. If the current and previous sample windows are the same, the system determines whether the user requested that the process be aborted 4250. If the current and previous sample windows are different, then the sample window processing routine 4200 checks its buffer to see if the frequency spectra has been determined in accordance with routine 4210. If not, the stabilization routine 4212 is performed. If the frequency spectra has been determined, then the harmonics filter routine 4211 is run before initializing the stabilization routine 4212.

Figure 14A:
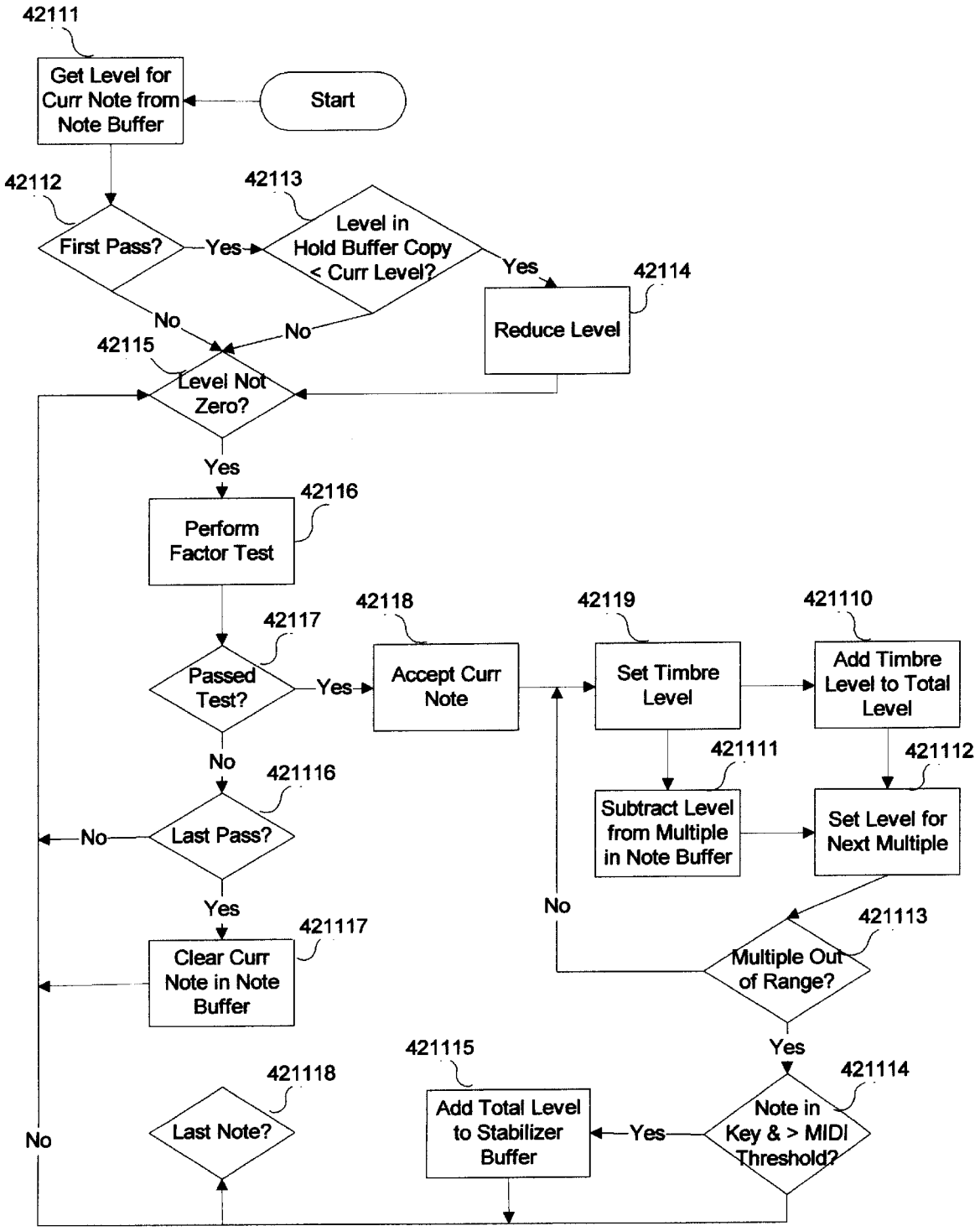
FIGS. 14(*a*) and (*b*) is a flow diagram of the harmonics filter sub-routine which filters out harmonic frequencies in accordance with the wave file to MIDI file converter of the instant invention.
Figure 14B:
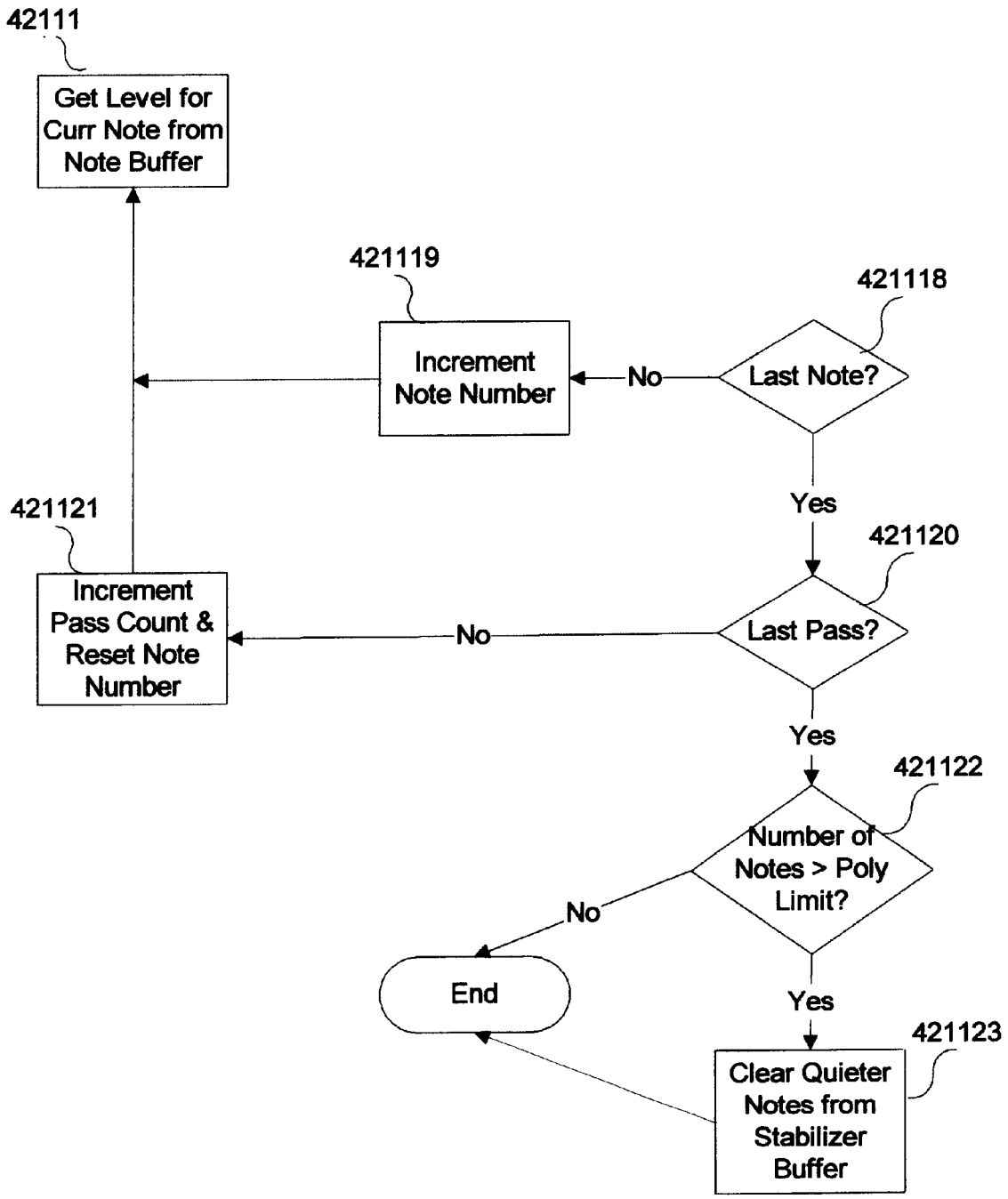

Referring to FIGS. 14*a*, 14*b*, 18*a*, 18*b* and 18*c*, the harmonics filter subroutine 421 is shown. If the current and previous sample windows are different, the recognizer 4000 filters out notes in the note buffer for the current window corresponding to harmonic frequencies and writes the notes corresponding to the remaining fundamental frequencies to the stabilizer buffer. That is, the harmonics filter subroutine 4211 is responsible for distinguishing between harmonic frequencies and the fundamental frequencies so that the fundamental frequencies may be isolated for writing to the MIDI file 6. Processing occurs in two passes from the minimum to the maximum note within the note range. The harmonic filter 4211 utilizes a two dimensional timbre buffer which holds amplitude levels for notes corresponding to each harmonic note within the note range. The harmonic filter 4211 first sets the level for the current note from the note buffer by obtaining the amplitude corresponding to the current note number from the note buffer. If this is the first pass through the harmonic filter 4211, 42112, the routine 4211 determines whether the level in the copy of the note buffer from the previous sample window corresponding to the current note is less than the current level obtained from the note buffer. If it is less, then the harmonic filter 4211 reduces the current level to the level in the copy of the note buffer. The harmonic filter then determines whether the level is at zero 42115. If it is not the first pass through the harmonic filter 4211 as determined in decision block 42112 or if the level in the copy of the note buffer is not less than the current level, as determined in decision block 42113, then the harmonic filter 4211 determines whether the current level is zero, in accordance with decision block 42115, without reducing the level. If the level is not zero, then the factor test is performed 42116. The factor test is performed by comparing the amplitude values in the stabilizer buffer for each note corresponding to factors of the frequency of the current note (derived from the multiple tables) to the sum of the current level and the values in the timbre buffer corresponding to the current note as the harmonic of the factor. If any of these values in the stabilizer buffer are greater, the current note fails the test, since it is a harmonic. If the test passes in accordance with decision block 42117, then the current note is accepted 42118, the current note is accepted, the current level is subtracted from the corresponding value in the note buffer. The current level is then added to this corresponding value in the note buffer copy. The total level is then set equal to the current level. Thereafter, the first multiple of the current note is obtained from the multiples table. The timbre level is then set 42119. To set the timbre level, the value in the timbre buffer corresponding to the current multiple of the current note is set equal to the lesser of the current note and the amplitude corresponding to the current multiple in the note buffer. This results in a series of gradually decreasing harmonic levels. The harmonic filter 4211 then simultaneously adds the timbre level to the total level 421110 and subtracts the level from the multiple in the note buffer 421111. When adding the timbre level to the total level, the value in the timbre buffer corresponding to the current multiple of the current note is added to the total level 42110. When subtracting the level from the current multiple in the note buffer, the lesser of the current note and the amplitude corresponding to the current multiple in the note buffer is subtracted from this value in the note buffer 421111. After adding and subtracting the relevant levels, the next multiple level is set 421112. To set the level for the next multiple, the filter harmonic routine 4211 uses linear regression to predict the current level written to the timbre buffer based on all previously written values for the current note. The current level is set to the greater of this predicted value and the value actually written to the timbre buffer corresponding to the current multiple. This helps prevent errors caused by a multiple level that is below the trend. The next multiple of the current note is then obtained from the multiples table. The harmonic filter routine 4211 then determines whether the multiple is out of range 421113. That is, the harmonic filter 4211 must determine whether the note corresponding to the current multiple is greater than the maximum note specified in the profile 13. If not, the harmonic filter again sets the timbre level and the current multiple level in accordance with steps 42119, 421110, 421111 and 421112. Once the multiple is out of range, then the harmonic filter 4211 checks whether the note is in key and above the MIDI threshold 421114 set in the profile 13. If not, the harmonic filter 4211 goes to decision block 42118 to see whether the last note in the note buffer has been examined. If the note is in key and above the MIDI threshold, then the harmonic filter 4211 adds the total level to the current level value in the stabilizer buffer corresponding to the current note 421115. Returning to decision block 42117, if the factor test fails, then the harmonic filter 4211 determines whether there has been a second pass through the note range 421116. If there has not been a second pass, then the harmonic filter 4211 goes to decision block 42118. If it is the second pass through the note range, then the current note in the note buffer is cleared 421117 by setting the amplitude in the note buffer corresponding to the current note zero. Hereafter the harmonic filter 4211 goes to decision block 42118. Referring to FIG. 14*b*, if the last or maximum note in the note range has not been processed 42118 then current the note number is incremented 421119 and the level for the current note from the note buffer is obtained 42111. When the maximum note in the range has been processed 421118, the harmonic filter inquires into whether the last pass, i.e. the second pass, has been completed through the note range. If the second pass through the note range has not been completed, then the harmonic filter 4211 increments the pass count by one and resets the current note number to the minimum note in the note range 421121 and then obtains the level for the current note from the note buffer 42111. If the second pass through the note range has been completed, 421120, the system can limit the number of simultaneous notes that are written to the MIDI file. Referring to FIG. 14, process 421122 checks if the number of notes detected are greater than a threshold (poly limit) set by the user in the profile. If so, process 421123 is performed, which sorts the amplitudes of the detected notes and lets only the loudest ones through. For example, if the poly limit is set to "3" and there are five (5) notes detected at the same time, the three (3) loudest ones are written to the stabilizer buffer for further processing, while the quieter two (2) are filtered out. Polyphonic music has a poly limit of "2" or more, while monophonic music has a limit=1. The rhythm-only mode (poly limit 0) is interpreted as monophonic mode at this point in the system, or else nothing would ever get written to the MIDI file. This improves recognition accuracy in music that is polyphonic but has a specific number of simultaneous notes, such as a singing duet, in which case the user would set the poly limit to 2.

Figure 15:
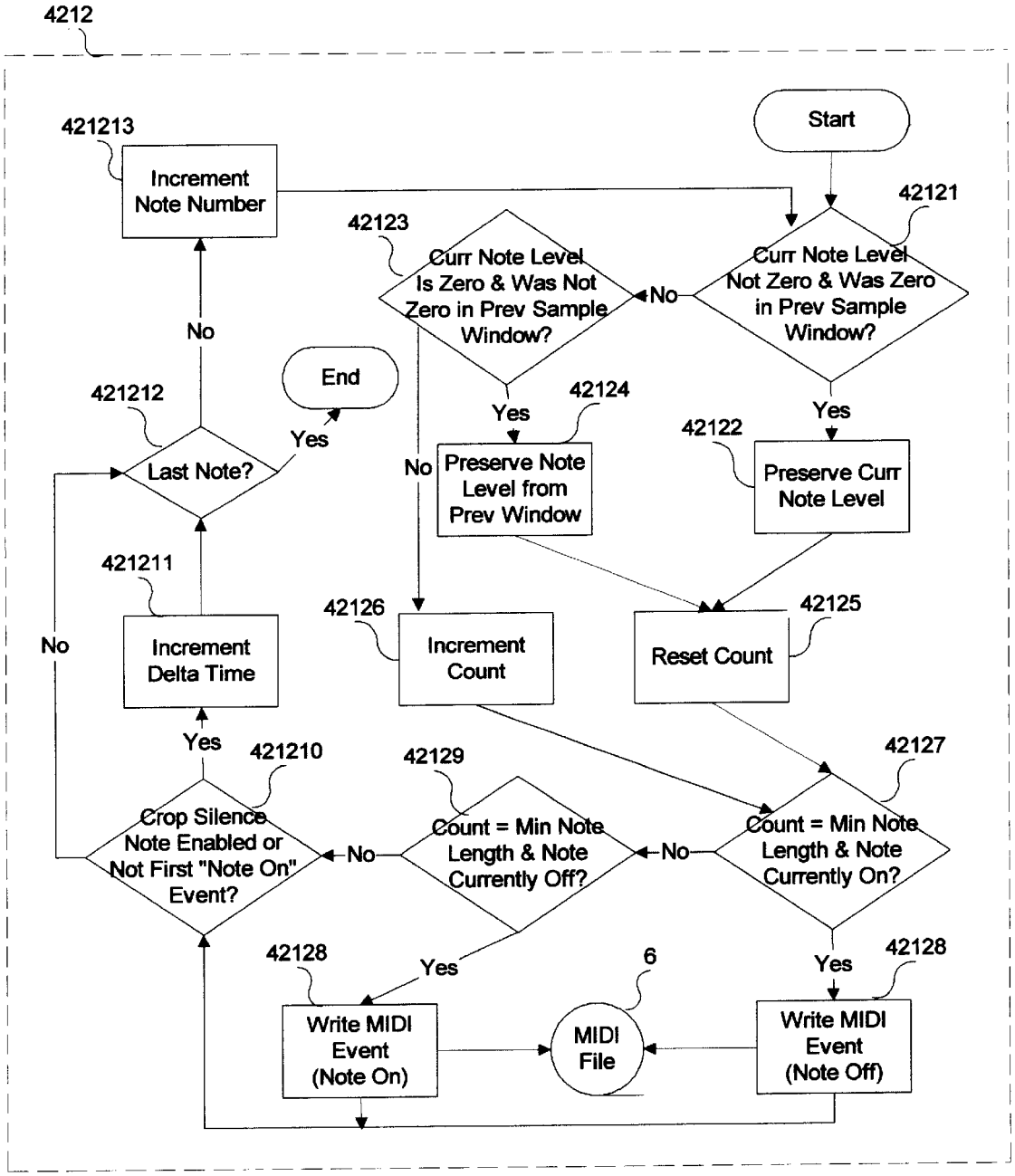
FIG. 15 is a flow diagram of the stabilization sub-routine which determines whether detected notes exist for a minimum number of sample windows in accordance with the wave file to MIDI file converter of the instant invention.

Referring back to FIG. 9, upon completing the harmonic filtering the sample window processing routine 4200 activates and runs a stabilization routine 4212 prior to writing the MIDI events to the MIDI file 6. The stabilization routine is run a number of times equal to the synchronization value returned for the averaging routine 4280. With reference to FIG. 15, the stabilization routine 4212 is shown. The effect of the stabilization filter upon a single note through time using various "minimum length" values is shown in FIG. 21. The stabilization filter 4212 gets rid of transitional errors caused by transients, that is, the transition of notes during the period of time covered by the sample windows. The theory behind the stabilization filter is that if a note is really present in the wave file 5, it will be present for at least two consecutive windows. Likewise, a note must not be present for 2 consecutive windows before it is considered to no longer be present in the wave file 5. Thus, the default minimum note length is 2; however, the user may increase the value by specifying it in the profile 13. The stabilization routine examines the note buffer for consecutive sample windows and ignores note on/off events for notes that are either present or not present for less than the minimum number of times specified in the profile. Note events that pass the filter are written to the MIDI file 6. This process is run once for each time frequency spectra is averaged together in the averager process routine 4280. The stabilization routine 4212 is run once for each note within the note range. It utilizes a stabilizer buffer which contains a current level, preserved level, previous level, counter and an on/off state flag for each note within the note range. In the first step, the stabilization routine 4212 determines whether the current level in the stabilizer buffer corresponding to the current note is not zero and whether this level was set at zero from the previous sample window 42121. If the current note level was not zero and was set to zero in the previous sample window, then the current level of the current note in the stabilizer buffer is preserved 42122. If decision block 42121 is answered in the negative, then the stabilization routine 4212 determines whether the current level in the stabilizer buffer corresponding to the current note is set at zero and whether this level was not zero from the previous sample window 42123. If the answer is no, then the counter for the current note in the stabilizer buffer is incremented by one 42126. If the answer is yes, then the previous level of the current note in the stabilizer buffer is preserved 42124. If the answer to either inquiry, 42121 or 42123, is yes, then the counter for the current note in the stabilizer buffer is set to one 42125. After updating the counter in either 42125 or 42126, the stabilizer routine 4212 determines whether the counter for the current note in the stabilizer buffer is equal to the minimum note length specified in the profile 13 and whether the current note is currently on 42127. If the counter is equal to the minimum note length specified in the profile and the current note is on then the recognizer 4000 writes the MIDI event as a note off event to the MIDI file indicating the current Delta time, MIDI channel, note number, and velocity using the write MIDI event routine 42128. The velocity is set equal to the amplitude. The MIDI channel number is obtained from the profile 13. If the inquiry to the decision block 42127 is no, then the stabilizer 4212 asks whether the counter for the current note in the stabilizer buffer is equal to the minimum note length specified in the profile and whether the current note is currently off. If the answer is yes, then a note on event is written to the MIDI file indicating the Delta time, MIDI channel, note number and velocity using the write MIDI event routine 42128. In either event the stabilization routine 4212 moves on to the next inquiry which determines whether the crop beginning silence feature is specified in the profile or whether any "note on" events have already occurred since the beginning of the recognition process 421210. If the answer is yes, then the Delta time is incremented by one 421211. In either event, the stabilizer routine 4212 next determines whether the current note number is equal to the maximum note number in the note range 421212. If the answer is yes, then the stabilizer routine 4212 ends and returns to the sample window processing routine 4200. If the current note number does not equal to the maximum note number in the note range then the current note number is incremented by one 421213 and the stabilizer routine 4212 returns to the first inquiry 42121, that is, whether the current note level is not zero and whether it was zero in the previous sample window.

Figure 16:
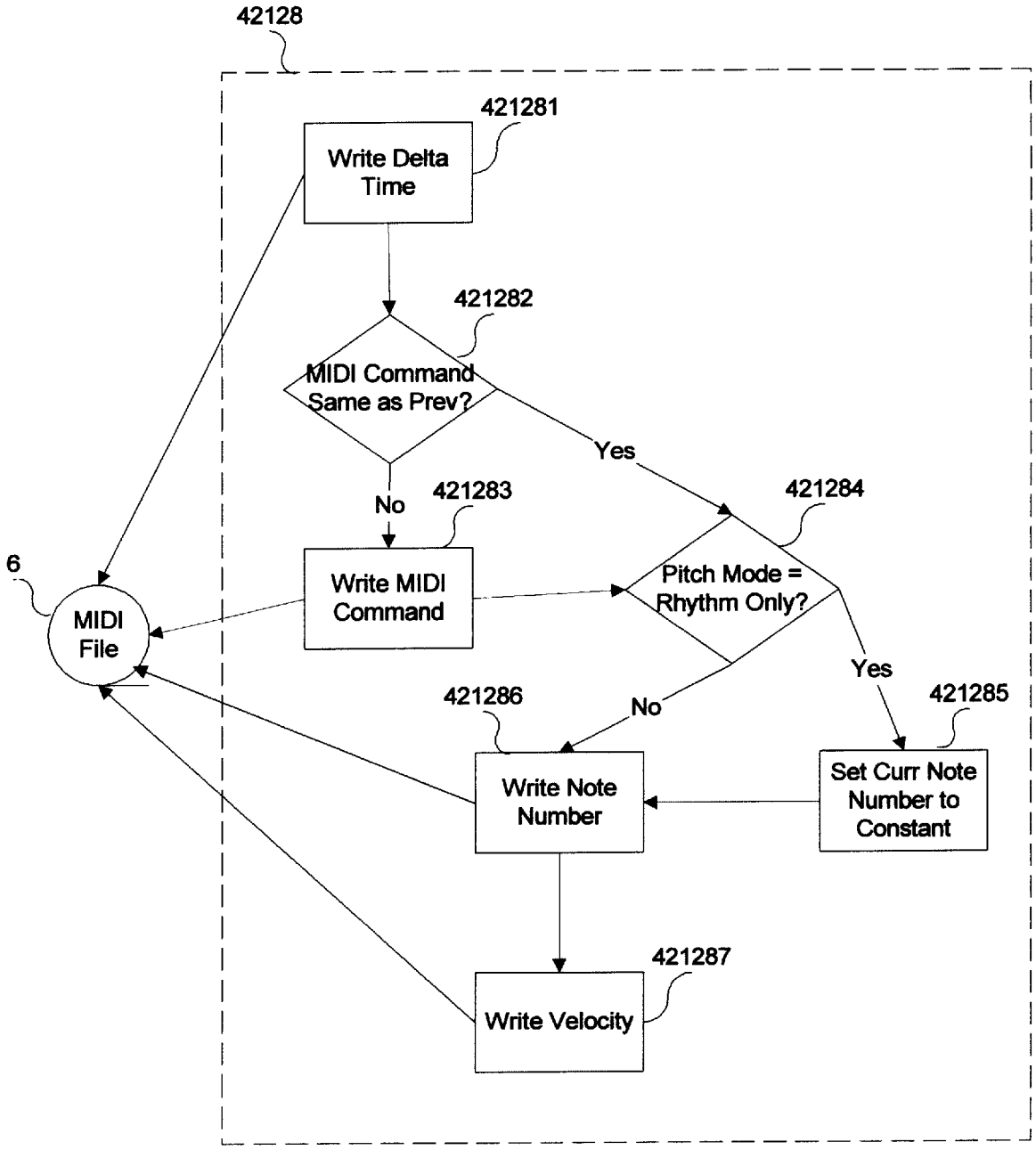
FIG. 16 is a flow diagram of the MIDI-event sub-routine which writes the detected note number, velocity, delta time, and MIDI command ("note on" or "note off") to the MIDI file in accordance with the wave file to MIDI file converter of the instant invention.

Referring to FIG. 16, the write MIDI event routine 42128 is shown. The write MIDI event routine 42128 writes a note on or note off event to the MIDI file indicating the Delta time, MIDI channel, note number and velocity. The velocity is equal to the amplitude. When writing a MIDI event, the recognizer 4000 first formats the Delta time to meet the MIDI standard, writes this time to the MIDI file, increments the MIDI file size counter and resets the Delta time to zero 421281. The MIDI event routine 42128 then combines the MIDI channel specified in the profile and the event type (that is off or on) to form a MIDI command and determines whether this command is equal to the command previously written to the MIDI file 421282. If not, the recognizer 4000 writes the MIDI command to the MIDI file 6 and increments the MIDI file size counter 421283. In either case, the MIDI event routine 42128 then determines whether the pitch mode is rhythm only 421284. If it is rhythm only, then the current note number is set to a constant 421285. In either case, the note number and velocity are written to the MIDI file 6 after evaluating the pitch mode. When writing the note number to the MIDI file 421286, the transposition value specified in the profile is added to the note number. The result is adjusted by increments of an octave (12 notes) if it is not within the allowable MIDI note range. The result is then written to the MIDI file and the MIDI file size counter is incremented 421286. When writing velocity to the MIDI file 421287, the velocity is set to a standard value if the velocity flag is disabled in the profile 13. Otherwise, the velocity is multiplied by the gain amount specified in the profile 13. The result is adjusted if it is not within the allowable MIDI velocity range. The result is written to the MIDI file and the MIDI file size counter is incremented. Referring to FIG. 9, after the stabilization routine 4212 is completed, decision block 4250 determines whether the user requested that the recognition process be aborted by checking the status File 14. If it is, the finish routine 4400 is run. If not, the percent complete is updated 4260 in the status file 14 and the next sample window is processed 4200.

Referring to FIG. 3, the sample window processor routine 4200 is cycled for every sample window making up the wave file. As each sample window is processed by the sample window processor routine 4200, the recognizer 4000 inquires as to whether the last window has been processed or whether there has been an abort requested 4300. When the answer to either is yes, the finish routine 4400 is implemented. The finish routine 4400 processes information from the last sample window. With reference to FIG. 4, the flush modules routine 4410 performs the averaging routine 4280 as shown in FIG. 13. If the current sample window is determined to be different from the previous window, then the harmonic filter routine 4211 and the stabilization routine 4212 are performed. Thereafter the MIDI header and trailer are written 4420. When writing the MIDI header and trailer, the standard trailer byte values are written to the end of the MIDI file 6, and the tempo, speed, time and key signature, patch setting and the value of the MIDI file size counter are written to the header. Finally, the write completion status 4430 is performed and any error or completion code is written to the status file 14.

OPTIMIZATION

The instant invention includes an optimization routine which looks at the score for the frequencies at different phases and amplitudes. If a score starts moving up (getting worse) as the phase of the sine wave is incremented, then subsequent phases are not looked at because the result will only get worse. The phase is shifted in the other direction until the best correlation at the current amplitude is found. Then the amplitude is shifted and the phase resulting in the best score at that amplitude is found. Amplitude is shifted in this manner until the amplitude-phase combination yielding the lower score is found. Once finding a best score for a particular frequency, the phase and amplitude are stored in memory for that sine wave. As previously noted, the best score comprises the minimum score. The theory is that only one minimum score exists for each frequency present in an aggregate wave form. A graph of best scores is shown in FIGS. 17 and 20. As a result, the minimum score is found by testing the least number of amplitude-phase combinations. In addition, the routine is further optimized by not comparing every pair of samples between the sine wave and aggregate wave, for reasons explained earlier. Similarly, amplitude and phase can be incremented more than one unit at a time.

If cluster detection is disabled, frequencies found to be present in the aggregate waveform do not need to be cancelled out, saving time.

Optimization works on the theory that certain properties or trends are consistent. Because there are consistent, predictable trends, it is not necessary to look at every combination of amplitude and phase. Optimization has several properties. A first property is based on the theory that there is always one minima. That is, when graphing the results of frequency scores from the amplitude and phase combinations, there will always be one minima which represents the best score for that frequency. The object is to find the lowest score. The lowest score is the best score. In a perfect world, the best score would be zero if all the detected frequencies were cancelled out. In reality, waveforms contain noise and non-musical frequencies.

A second constant property relates to the amplitude. An amplitude of zero does not modify the best score. Regardless of the phase shift, an amplitude of zero will always yield the same score. A base line score is therefore created for an amplitude of zero. The base line score is the score found when you have a sine wave of interest with an amplitude of zero. In reference to the calculation of the best score, the worst best score is never greater than the base line score, since a sine wave amplitude of zero subtracted from the aggregate wave samples does not change the value of the score. Accordingly, the base line score is determined by squaring and then adding together each sample value from the digitized aggregate/complex wave form. The best possible score is always zero.

Once the base line score is known, we can gauge whether the frequency is likely to be present, and whether the score is improving as the amplitude and phase are shifted. Therefore, the invention established a base line score by starting at zero amplitude. Then a score is established for a selected frequency at a minimal amplitude. If the best score for the selected frequency is not better than the base line score, then it is known that the selected frequency is not present. If it improves, then the invention looks at amplitude and phase shift combination for that frequency. If the score gets worse, that is, close to the base line score, as the amplitude and/or phase are shifted in one direction, the direction of the amplitude shift is reversed. For instance, assume a starting point of amplitude one, and phase zero produces a better score than the base line score. Next, the sine wave is shifted to amplitude one and phase one to see whether a shift in the phase improves the score. If the score gets worse with the direction of the phase shift, then the phase is changed to negative 1, that is, shifted in an opposite direction. If the score and amplitude one, phase minus one is better than at phase zero, then it is known that the best score for the tested frequency is at amplitude one, phase minus one. Phase continues to be adjusted until the score gets worse again. Eventually, the best score for amplitude one and its corresponding phase is found without wasting too much time calculating the score for sine wave parameters that do not improve the score.

The sine wave sample is then shifted to amplitude two at best phase at amplitude one to eventually find the best phase at amplitude two. Once the best score and phase for amplitude two is found, it is compared to amplitude one. If the score improved at amplitude two and its corresponding phase, then the invention keeps working up the amplitudes. If the best score for amplitude one is better, i.e., lower, than the best score for amplitude two, then it is determined that a sine wave of amplitude one and phase one is present in the aggregate wave form. If the score gets worse when increasing the amplitude and/or phase in one direction, then the polarities are reversed, as previously noted, so that further increments will approach the phase and amplitude of the sine wave for the correct frequency present in the aggregate wave form. Since trends can be determined to predict whether a frequency at a known phase and amplitude will produce a better score, it is not necessary to do calculations for every phase and amplitude combination.

It has been determined that this procedure can reduce the number of calculations which have to be made by 90 percent. Amplitude and phase shift are always examined in combination to look for trends. The trends can be relied on since there is only one minima in each frequency domain.

The optimization portion of the invention also accounts for the fact that phase is circular. Since phase repeats itself, only half the wave length has to be looked at. Preferably, the range or phase under which calculations are performed is from a negative one/fourth wave length to a positive one/fourth wave length. This saves time and memory, which is always desired. In fact, this reduces the memory used by 50 percent for the phase portion of the program. Instead of looking at 360 degrees of phase shifting, the invention looks at, at most, 180 degrees of phase shifting. Negative amplitudes account for the other 180 degrees of phase shifting.

If the pause between notes feature is enabled, time is saved by finding the frequency spectra only once each time a sample window level exceeds a threshold level. This is because the pause between notes feature assumes that only one set of frequencies exist between periods of silence.

It is to be kept in mind that this invention can be used to identify frequencies in any type of wave-format signal, and the references herein to musical/audible signals is by way of example only and not intended to limit the scope of my invention.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A method of identifying one or more fundamental frequencies simultaneously present in a complex signal, comprising the steps of:

receiving the complex signal;

decomposing the signal into sine wave components to determine all frequencies present in the signal;

setting and obtaining parameters used to detect fundamental frequencies; and filtering out harmonic frequencies to determine the fundamental frequencies actually present in the signal.

2. The method of claim 1, wherein the step of receiving the complex signal includes dividing the signal into a series of sample windows which contain sample amplitudes.

3. The method of claim 2, further comprising an optimization step of ignoring sample windows in which the sample amplitudes do not meet a predetermined threshold.

4. The method of claim 2, wherein the step of decomposing includes obtaining best correlation scores by comparing reference frequencies to the complex signal, and comparing said best correlation scores to determine which reference frequencies are in the complex signal.

5. The method of claim 4, wherein the step of decomposing is carried out by comparing amplitudes resulting in the best correlation score at each reference frequency to amplitudes resulting in best correlation scores at adjacent reference frequencies to locate amplitude peaks.

6. The method of claim 4, wherein the step of decomposing includes the step of scaling the amplitudes of the detected frequencies according to said frequencies.

7. The method of claim 4, wherein the step of obtaining the best correlation scores comprises shifting the amplitude and phase of the reference frequencies until an amplitude/phase combination yielding the best correlation score out of all correlation scores for said combinations of each reference frequency is found.

8. The method of claim 4, further comprising the step of attenuating frequencies lower than current reference frequencies before correlation scores are obtained.

9. The method of claim 8, wherein said attenuation step comprises:

a high-pass filter having a cutoff frequency set to the current reference frequency; and a low-pass filter having a cutoff frequency set to one half of the current reference frequency.

10. The method of claim 7, further comprising an optimization step of ignoring amplitude/phase combinations which yield correlation scores that are worse than previously obtained correlation scores.

11. The method of claim 7, wherein the step of obtaining correlation scores includes:

subtracting samples in the current reference frequency from corresponding samples in the sample window;

squaring each difference; and summing the results.

12. The method of claim 11, wherein the current reference frequencies are stored and utilized as a sine wave table.

13. The method of claim 11, wherein the step of obtaining correlation scores includes the step of subtracting the reference frequencies from the complex signal.

14. The method of claim 1, wherein the complex signal represents one or more musical notes.

15. The method of claim 4, further comprising an optimization step in which frequencies that are not within a range of frequencies established by predetermined parameters are disregarded.

16. The method of claim 4, further comprising an optimization step in which frequencies that are not within the frequencies represented by a predetermined musical key are disregarded.

17. The method of claim 1, wherein the step of decomposing includes:

determining the duration of all frequencies;

determining the amplitude of all frequencies; and determining the phase of all frequencies.

18. The method of claim 4, further comprising the step of comparing frequencies identified in one sample window with frequencies identified in adjacent sample windows to ascertain whether the windows contain substantially the same set of frequencies.

19. The method of claim 18, wherein the method of computing includes:

summing the lesser amplitudes of each pair of corresponding frequencies;

dividing by the sum of the greater amplitudes of each said pair; and comparing the result to a predetermined threshold level.

20. The method of claim 18, further comprising the step of counting successive sample windows determined to contain substantially the same set of frequencies to obtain a duration component of said frequencies.

21. The method of claim 1, wherein the step of filtering out harmonic frequencies comprises examining amplitudes of frequencies that are multiples of each previously detected frequency and subtracting a portion of each amplitude that is not greater than an amplitude of the previous harmonic and adding that to the amplitude of the previously detected frequency.

22. The method of claim 21, wherein multiples of fundamental frequencies identified in the immediately preceding sample window are examined in a first iteration, and thereafter an entire set of reference frequencies are reprocessed to identify any additional fundamental frequencies not identified in the first iteration.

23. The method of claim 21, wherein the step of filtering out harmonics further comprises comparing amplitudes of frequencies that appear to be fundamental to amplitudes of fundamental frequencies that have previously been identified to determine if a current frequency is in fact a harmonic of one of any previously identified fundamental frequencies.

24. The method of claim 21, wherein the step of filtering out harmonics employs linear regression to predict expected amplitudes in a harmonic series to at least partially correct error.

25. The method of claim 21, wherein the step of filtering out harmonics further comprises disregarding any fundamental frequencies having an amplitude below a predetermined threshold.

26. The method of claim 2, further comprising the step of reducing error caused by transition of fundamental frequencies between sample windows to determine whether each detected frequency is actually present in the signal.

27. The method of claim 26, wherein the step of reducing error disregards what appears to be identified fundamental frequencies that fail to appear in a predetermined number of successive sample windows.

28. The method of claim 1, further comprising the step of representing detected fundamental frequencies, as well as durations and amplitudes of said detected fundamental frequencies, as MIDI (Musical Instrument Digital Interface) information.

29. The method of claim 28, further comprising the step of representing tempo, time signature, key signature, and instrument patch settings as MIDI (Musical Instrument Digital Interface) information.

30. An apparatus for automatically detecting one or more fundamental frequencies simultaneously present in a complex signal, said apparatus comprising:

means for receiving the complex signal;

means for decomposing the signal into sine wave components to determine all frequencies present in the signal;

means for setting and obtaining parameters used by said apparatus; and means for filtering out harmonic frequencies to determine the fundamental frequencies actually present in the signal.

31. The apparatus of claim 30, wherein the means for receiving the complex signal includes means for dividing the signal into a series of sample windows which contain sample amplitudes.

32. The apparatus of claim 31, further comprising an optimization means for ignoring sample windows in which the sample amplitudes do not meet a predetermined threshold.

33. The apparatus of claim 31, wherein the means for decomposing includes means for comparing best correlation scores obtained by comparing reference frequencies to the complex signal to determine which reference frequencies are in the complex signal.

34. The apparatus of claim 33, wherein the means for decomposing compares amplitudes resulting in the best correlation score at each reference frequency to amplitudes resulting in best correlation scores at adjacent reference frequencies to locate amplitude peaks.

35. The apparatus of claim 33, wherein the means for decomposing includes a means for scaling the amplitudes of the detected frequencies according to said frequencies.

36. The apparatus of claim 33, wherein the means for obtaining the best correlation scores comprises shifting the amplitude and phase of the reference frequencies until an amplitude/phase combination yielding the best correlation score out of all correlation scores for said combinations of each reference frequency is found.

37. The apparatus of claim 33, further comprising means for attenuating frequencies lower than current reference frequencies before correlation scores are obtained.

38. The apparatus of claim 37, wherein said means for attenuating comprises:

a high-pass filter having a cutoff frequency set to the current reference frequency; and a low-pass filter having a cutoff frequency set to one half of said current reference frequency.

39. The apparatus of claim 36, further comprising an optimization means for ignoring amplitude/phase combinations which yield correlation scores that are worse than previously obtained correlation scores.

40. The apparatus of claim 36, wherein the means for obtaining correlation scores employs:

means for subtracting each sample of the current reference frequency from a corresponding sample in the sample window;

means for squaring each difference; and means for summing the results.

41. The apparatus of claim 40, wherein the current reference frequencies are stored and utilized as a sine wave table.

42. The apparatus of claim 40, wherein the means for obtaining correlation scores includes a means for subtracting the reference frequencies from the complex signal.

43. The apparatus of claim 30, wherein the complex signal represents one or more musical notes.

44. The apparatus of claim 33, further comprising an optimization means for disregarding frequencies that are not: within a range of frequencies established by predetermined parameters.

45. The apparatus of claim 33, further comprising an optimization means for disregarding frequencies that are not within the frequencies represented by a predetermined musical key.

46. The apparatus of claim 30, wherein the means for decomposing comprises:

means for determining the duration of all frequencies;

means for determining the amplitude of all frequencies; and means for determining the phase of all frequencies.

47. The apparatus of claim 33, further comprising means for comparing frequencies identified in one sample window with frequencies identified in adjacent sample windows to ascertain whether the windows contain substantially the same set of frequencies.

48. The apparatus of claim 47, wherein the means for comparing includes:

means for summing the lesser amplitudes of each pair of corresponding frequencies;

means for dividing by the sum of the greater amplitudes of each said pair; and means for comparing the result to a predetermined threshold level.

49. The apparatus of claim 47, further comprising means for counting successive sample windows determined to contain substantially the same set of frequencies to obtain a duration component of said frequencies.

50. The apparatus of claim 30, wherein the means for filtering out harmonic frequencies comprises means for examining amplitudes of frequencies that are multiples of each previously detected frequency, means for subtracting a portion of each amplitude that is not greater than the amplitude of the previous harmonic, and means for adding the portion of each amplitude that is not greater than the amplitude of the previous harmonic to the amplitude of the previously detected frequency.

51. The apparatus of claim 50, wherein multiples of fundamental frequencies identified in the immediately preceding sample window are examined in a first iteration, and thereafter an entire set of reference frequencies are reprocessed to identify any additional fundamental frequencies not identified in the first iteration.

52. The apparatus of claim 50, wherein said means for filtering out harmonics further comprises means for comparing amplitudes of frequencies that appear to be fundamental to amplitudes of fundamental frequencies that have previously been identified to determine if a current frequency is in fact a harmonic of one of any previously identified fundamental frequencies.

53. The apparatus of claim 50, wherein said means for filtering out harmonics employs linear regression to predict expected amplitudes in a harmonic series to at least partially correct error.

54. The apparatus of claim 50, wherein said means for filtering out harmonics further comprises a means for disregarding any fundamental frequencies having an amplitude below a predetermined threshold.

55. The apparatus of claim 31, further comprising means for reducing error caused by transition of fundamental frequencies between sample windows to determine whether each detected frequency is actually present in the signal.

56. The apparatus of claim 55, wherein said means for reducing error disregards what appears to be identified fundamental frequencies that fail to appear in a predetermined number of successive sample windows.

57. The apparatus of claim 55, further comprising a means for representing detected frequencies, as well as durations and amplitudes thereof, as MIDI (Musical Instrument Digital Interface) information.

58. The apparatus of claim 30, further comprising a means for representing tempo, time signature, key signature, and instrument patch settings as MIDI (Musical Instrument Digital Interface) information.

* * * * *